US011359317B2

(12) United States Patent
Yano et al.

(10) Patent No.: US 11,359,317 B2
(45) Date of Patent: Jun. 14, 2022

(54) EDGE CLAMPING DEVICE AND AUTOMATIC CLOTH SPREADING MACHINE INCLUDING THE SAME

(71) Applicant: PUREX CO., LTD., Takamatsu (JP)

(72) Inventors: Makoto Yano, Takamatsu (JP); Yuichiro Yabe, Takamatsu (JP)

(73) Assignee: PUREX CO., LTD., Takamatsu (JP)

( * ) Notice: Subject to any disclaimer, the term of this patent is extended or adjusted under 35 U.S.C. 154(b) by 77 days.

(21) Appl. No.: 17/046,030

(22) PCT Filed: Apr. 10, 2019

(86) PCT No.: PCT/JP2019/015576
§ 371 (c)(1),
(2) Date: Oct. 8, 2020

(87) PCT Pub. No.: WO2019/198741
PCT Pub. Date: Oct. 17, 2019

(65) Prior Publication Data

US 2021/0032791 A1 Feb. 4, 2021

(30) Foreign Application Priority Data

Apr. 12, 2018 (JP) ..... JP2018-077104

(51) Int. Cl.
*D06C 3/02* (2006.01)
*D06F 89/00* (2006.01)
(Continued)

(52) U.S. Cl.
CPC ..... *D06C 3/02* (2013.01); *D06F 89/00* (2013.01)

(58) Field of Classification Search
CPC . D06C 3/02; D06F 89/00; D06F 67/04; D06F 93/00; D06F 95/00; B65G 47/90; G65H 29/10; G65H 31/02; G65H 5/08
See application file for complete search history.

(56) References Cited

U.S. PATENT DOCUMENTS 5,168,645 A * 12/1992 Robin ..... D06F 95/00 198/465.4
5,416,992 A * 5/1995 Ueda ..... D06F 67/04 198/689.1
(Continued)

FOREIGN PATENT DOCUMENTS

JP H07-231998 A 9/1995
JP 2010-000561 A 1/2010
(Continued)

OTHER PUBLICATIONS

Apr. 30, 2021 Extended European Search Report issued in European Patent Application No. 19785400.3.
(Continued)

*Primary Examiner* — Ismael Izaguirre
(74) *Attorney, Agent, or Firm* — Oliff PLC

(57) ABSTRACT

An edge clamping device includes: a two-position holding device having a pair of holding chucks that hold two separate portions of a rectangular piece of cloth Y that are on or near the ridge of a fold, in a state where a right-angled triangular part S is revealed; an edge locating conveyor that is disposed under the two-position holding device and delivers the cloth Y having been released from the two-position holding device; clamping chucks disposed downstream of the edge locating conveyor in a delivery direction; and a position changing means that moves at least one of the two-position holding device, the edge locating conveyor, and the clamping chucks in a crosswise direction such that the right-angled triangular part S of the cloth Y held by the two-position holding device is located at a correct clamping position corresponding to the positions of the clamping chucks.

16 Claims, 23 Drawing Sheets

(51) Int. Cl.
*D06F 87/00* (2006.01)
*D06F 67/04* (2006.01)

(56) References Cited

U.S. PATENT DOCUMENTS

| | | | | |
|---|---|---|---|---|
| 6,477,797 | B1 * | 11/2002 | Takahashi | D06F 67/04 38/143 |
| 6,533,267 | B1 * | 3/2003 | Muessig | D06H 3/04 112/306 |
| 6,584,711 | B1 * | 7/2003 | Nakamura | D06F 67/04 38/143 |
| 2013/0249157 | A1 * | 9/2013 | Endo | B23Q 3/18 29/559 |

FOREIGN PATENT DOCUMENTS

| | | | |
|---|---|---|---|
| JP | 2010-222724 | A | 10/2010 |
| JP | 2010273732 | A * | 12/2010 |
| JP | 2011-030743 | A | 2/2011 |
| WO | 96/21765 | A1 | 7/1996 |
| WO | 2012/073500 | A1 | 6/2012 |

OTHER PUBLICATIONS

Jul. 16, 2019 International Search Report issued in International Patent Application No. PCT/JP2019/015576.

* cited by examiner (a)

(b)

EDGE CLAMPING DEVICE AND AUTOMATIC CLOTH SPREADING MACHINE INCLUDING THE SAME

TECHNICAL FIELD

The present invention relates to an edge clamping device that locates an edge of cloth and clamps that side edge in a cloth washing factory or the like. The present invention further relates to an automatic cloth spreading machine that spreads cloth by hanging the cloth having been clamped by the edge clamping device onto a roller and then pulling the cloth from a rear edge side.

BACKGROUND ART

As this type of edge clamping device, one that includes a two-position holding device, an edge locating conveyor disposed under the two-position holding device, and a clamping chuck disposed downstream of the edge locating conveyor in a delivery direction has been hitherto proposed (see Patent Literature 1). An overview of this configuration is shown in FIG. 35. The two-position holding device has a pair of holding chucks 71, 72 that hold two separate portions (in FIG. 35, a corner end portion and an intermediate portion) of a rectangular piece of cloth Y that are on or near the ridge of a fold, in a state where the cloth Y has been folded with a side edge Yc on a side to be located and the opposite side edge Yd intersecting each other so as to reveal a right-angled triangular part S of which an adjacent side Sa is formed by a portion of the side edge Yc on the side to be located that is adjacent to the corner of intersection while a hypotenuse Sb is formed by a portion of the opposite side edge Yd that defines the corner of intersection with the adjacent side Sa. An edge locating conveyor 8 delivers the cloth Y having been released from the two-position holding device. In this edge clamping device, the two-position holding device releases the two held portions at different timings such that the portion on the side of the right-angled triangular part S (the side of the corner end portion) follows, and lets them fall onto the edge locating conveyor 8. On the edge locating conveyor 8, the cloth Y is rotated and the adjacent side Sa of the right-angled triangular part S is thereby located. The clamping chucks 92, 93 operate so as to clamp a peripheral portion inside the right-angled triangular part S including the located adjacent side Sa.

CITATION LIST

Patent Literature

Patent Literature 1: JP-A-2010-222724

SUMMARY OF INVENTION

Technical Problem

In a washing factory where many types of cloth varying in size from small to large, such as bath towels, face towels, and pillowcases, are handled, the shape and size of the right-angled triangular part S that appears in cloth Y held by the two-position holding device vary depending on the shape and size of the cloth Y (see FIG. 36 (*a*) and FIG. 36 (*b*)). Further, in some cases, the position of the folding line of cloth Y held by the two-position holding device 7 does not coincide with that of the diagonal line of the cloth Y, and also in such cases, the size and shape of the right-angled triangular part S to be appeared vary (see FIG. 36 (*c*)). This results in variations in the clamping position when the clamping chucks 92, 93 downstream of the edge locating conveyor 8 clamp a portion of the cloth Y around the adjacent side Sa of the right-angled triangular part S that has been located on the edge locating conveyor 8. For example, when a right-angled triangular part S' as indicated by the dashed line in FIG. 35 appears, the clamping chuck 92 that is the left one of the two clamping chucks 92, 93 is not located at a position at which it can clamp the cloth Y and therefore may fail to grasp the cloth Y. When a right-angled triangular part S" as indicated by the dashed line appears, both of the clamping chucks 92, 93 can clamp the cloth Y, while portions being clamped are located on an inner side of the correct positions, which is problematic because it decreases the processing accuracy in hanging the cloth Y onto the roller and spreading the cloth Y in later steps. When the right-angled triangular part S having appeared is extremely small as shown in FIG. 37, the clamping chuck 93 clamps not only the located side edge Yc but also the opposite side edge Yd that is not supposed to be clamped, which is problematic because it makes the entire subsequent processing impossible.

An object of the present invention is to solve the problems with the above prior art and provide an edge clamping device that can clamp cloth, of which an edge has been located on an edge locating conveyor, in a reliable manner and at a correct position, and an automatic cloth spreading machine including this device.

Solution to Problem

To solve the above problem, an edge clamping device of the present invention includes: a two-position holding device having a pair of holding chucks that hold two separate portions of a rectangular piece of cloth that are on or near the ridge of a fold of the cloth, in a state where the cloth has been folded with a side edge on a side to be located and the opposite side edge intersecting each other so as to reveal a right-angled triangular part of which an adjacent side is formed by a portion of the side edge on the side to be located that is adjacent to the corner of intersection while a hypotenuse is formed by a portion of the opposite side edge that defines the corner of intersection with the adjacent side; an edge locating conveyor that is disposed under the two-position holding device with a delivery direction oriented in a direction orthogonal to a direction in which the pair of holding chucks face each other, and delivers the cloth having been released from the two-position holding device; and a clamping chuck disposed downstream of the edge locating conveyor in the delivery direction. The two-position holding device releases the two held portions separately and lets them fall onto the edge locating conveyor at different timings such that the portion on the side of the right-angled triangular part follows, whereby the adjacent side of the right-angled triangular part is located on the edge locating conveyor, and the clamping chuck clamps a peripheral portion inside the right-angled triangular part including the located adjacent side. The edge clamping device includes a position changing means that moves at least one of the two-position holding device, the edge locating conveyor, and the clamping chuck in a crosswise direction relative to the delivery direction such that the right-angled triangular part of the cloth held by the two-position holding device is located at a correct clamping position corresponding to the position of the clamping chuck. Here, "locating an edge" means revealing the adjacent side of the right-angled triangular part on the edge locating conveyor so as to be easily clamped by the clamping chuck. Specifically, this term refers to adjusting the direction of the adjacent side of the right-angled triangular part so as to be substantially at a right angle to the delivery direction of the edge locating conveyor by keeping a part of the cloth in a state of being held by the two-position holding device while delivering and moving the rest of the cloth that has landed on the edge locating conveyor.

In addition, it is preferable that the edge clamping device of the present invention include a sensor that detects the position of a right-angled portion of the right-angled triangular part in a state where the two-position holding device is holding two portions of the cloth, and that the position changing means be configured to move at least one of the two-position holding device, the edge locating conveyor, and the clamping chuck in a crosswise direction relative to the delivery direction based on the position of the right-angled portion detected by the sensor.

In the edge clamping device of the present invention, it is preferable that the position changing means has a moving mechanism that moves the two-position holding device in a crosswise direction relative to the delivery direction.

Further, in the edge clamping device of the present invention, it is preferable that the two-position holding device has an interval changing mechanism that changes the distance between the pair of holding chucks.

An automatic cloth spreading machine of the present invention that solves the above problems includes: one of the above-described edge clamping devices; a vertically inverting device that inverts the clamping chuck having clamped cloth; a roller disposed under the edge locating conveyor; a hanging movable body that receives the cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

Advantageous Effects of Invention

The edge clamping device and the automatic cloth spreading machine including this device of the present invention are configured to be able to move at least one of the two-position holding device, the edge locating conveyor, and the clamping chuck in a crosswise direction relative to the delivery direction of the edge locating conveyor by the position changing means. Even when the shape and size of the right-angled triangular part appearing in cloth held by the two-position holding device vary due to a change in the type of cloth to be processed etc., the position changing means compensates for the positional deviation of the right-angled triangular part from the correct clamping position corresponding to the position of the clamping chuck. Therefore, the edge clamping device and the automatic cloth spreading machine including this device of the present invention can clamp cloth, of which an edge has been located on the edge locating conveyor, in a reliable manner and at a correct position by the holding chucks. This makes it possible to process a plurality of types of cloth varying in shape and size by a single edge clamping device.

DESCRIPTION OF EMBODIMENT

An embodiment of an edge clamping device and an automatic cloth spreading machine including this device of the present invention will be described in detail below based on the drawings.

Figure 1:
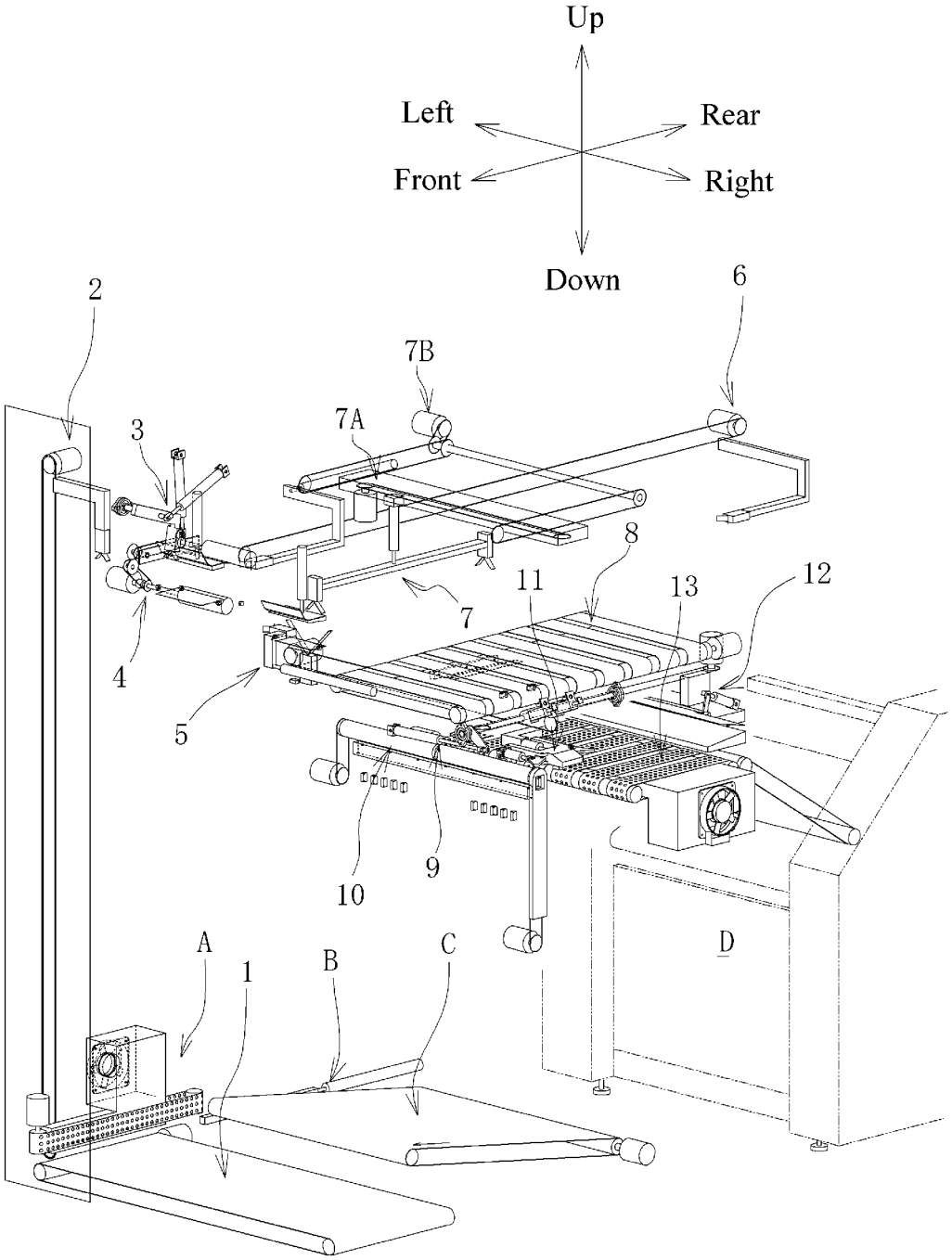
FIG. 1 is a schematic overall view of an automatic cloth spreading machine of one embodiment of the present invention.

FIG. 1 shows an overall view of the automatic cloth spreading machine of one embodiment of the present invention, and FIG. 2 to FIG. 34 show individual devices that are parts of the automatic cloth spreading machine of FIG. 1. In the following description, the directions of front, rear, right, left, up, and down refer to those directions in the state of FIG. 1.

The automatic cloth spreading machine automatically spreads washed and dried pieces of cloth varying in shape and size, such as bath towels, face towels, sheets, duvet covers, and pillow covers. As shown in FIG. 1, the automatic cloth spreading machine mainly includes a supply conveyor 1, a lifting device 2, a temporary holding device 3, a corner end locating device 4, a corner end receiving device 5, a horizontal pulling device 6, a two-position holding device 7, an edge locating conveyor 8, a vertically inverting device 9, a roller 10, a hanging device 11, a forward-backward moving device 12, a transfer conveyor 13, and a controller (not shown) that controls the operations of all devices including the devices 1 to 13. In FIG. 1, a suction conveyor A, a push-out device B, a return conveyor C, and a cloth folding machine D are shown as assisting or related devices. The return conveyor C returns cloth that has fallen during processing to the supply conveyor 1.

The automatic cloth spreading machine operates roughly as follows. Specifically, the supply conveyor 1 supplies washed and dried cloth to below the lifting device 2. The lifting device 2 lifts the cloth to a predetermined level. The temporary holding device 3 receives the lifted cloth, temporarily holds the cloth, and moves the cloth to a position at which the cloth is passed to the corner end locating device 4. The corner end locating device 4 receives an arbitrary portion of the cloth hanging from the temporary holding device 3 and reveals a corner end of the cloth. The corner end receiving device 5 holds this corner end, and moves the cloth toward the horizontal pulling device 6 while supporting the cloth in a drooping state. The horizontal pulling device 6 lays the cloth substantially horizontally in a front-rear direction. The two-position holding device 7 holds the laid cloth at two positions, one near a corner end and the other in a predetermined portion on the rear side of the corner end, at the same level, moves the cloth to above the edge locating conveyor 8, and then releases the rear-side portion of the cloth being held. The edge locating conveyor 8 receives thereon a fallen portion of the cloth that is still held at the position near the corner end by the two-position holding device 7, and moves that portion so as to reveal one long-side edge of the cloth. The vertically inverting device 9 holds the long-side edge of the cloth coming down from the edge locating conveyor 8, inverts the cloth upside down, and then holds the cloth in a drooping state. A hanging movable body 11A of the hanging device 11 that moves above the roller 10 in a left-right direction along the roller 10 receives the long-side edge of the cloth from the vertically inverting device 9 and hangs the drooping cloth on the roller 10. The roller 10 delivers the cloth hung thereon such that the cloth droops toward the forward-backward moving device 12 while a short-side edge of the cloth is left on the roller 10. The forward-backward moving device 12 moves forward and receives the rear-side short-side edge of the cloth left on the roller 10, moves backward while holding the short-side edge of the cloth, and then moves the cloth in a spread state onto the transfer conveyor 13. The transfer conveyor 13 discharges the spread cloth and, for example, feeds the cloth into the cloth folding machine D in the next process.

Figure 2:
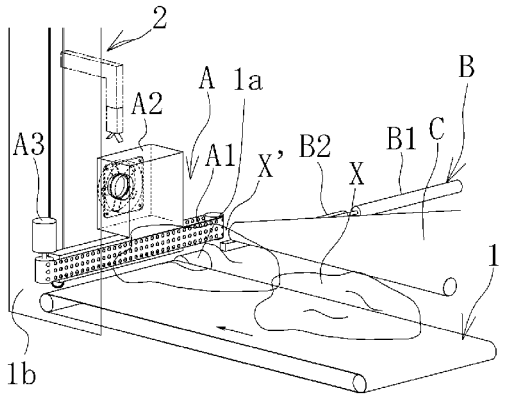
FIG. 2 is an enlarged perspective view of a supply conveyor and a lifting device of the automatic cloth spreading machine of FIG. 1.
Figure 3:
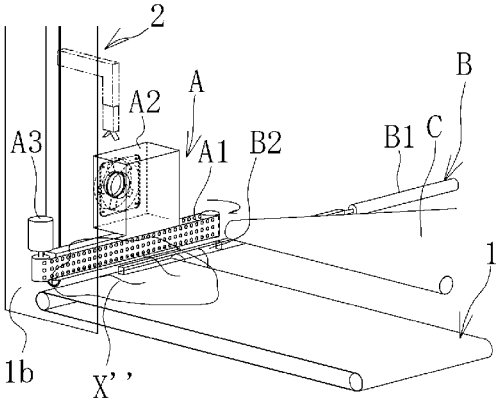
FIG. 3 is an enlarged perspective view of the supply conveyor and the lifting device of the automatic cloth spreading machine of FIG. 1.

Each device will be described in detail. First, as shown in FIG. 1 to FIG. 3, the supply conveyor 1 may be continuously run by a motor 1*a* during operation. A mass X consisting of, for example, about 10 to 50 washed and dried, still balled-up rectangular pieces of cloth Y is thrown onto the supply conveyor 1. The supply conveyor 1 transfers the mass X of the cloth Y to below the lifting device 2 (indicated by reference sign X' in FIG. 2). The suction conveyor A is provided at a terminal end of the supply conveyor 1 in a transfer direction. The suction conveyor A is composed of a perforated belt A1, a suction fan A2 that suctions the cloth Y on the supply conveyor 1 through the perforated belt A1, and a motor A3 that drives the perforated belt A1 to rotate and thereby transfers the suctioned cloth Y to directly below the lifting device 2 (indicated by reference sign X" in FIG. 3). A wall 1*b* that prevents the mass X from falling off the supply conveyor 1 is formed standing near a terminal end of the perforated belt A1. Furthermore, in addition to or instead of the suction conveyor A, the push-out device B that pushes the cloth on the supply conveyor 1 to directly below the lifting device 2 may be provided at the terminal end of the supply conveyor 1 in the transfer direction. The push-out device B is composed of a cylinder B1 and a push-out rod B2 that is moved forward and backward by the cylinder B1.

The lifting device 2 has a chuck 21 that holds an arbitrary portion of the cloth Y, and an upward-downward moving device that moves the chuck 21 upward and downward. In the example shown in FIG. 4, the upward-downward moving device is composed of a driving belt 23 and a motor 22. The upward-downward moving device may have any structure as long as it can move the chuck 21 upward and downward between a predetermined level and a transfer surface of the supply conveyor 1. For example, a chain-driven device or a slider unit that travels along a rail installed in an up-down direction may be used as the upward-downward moving device. When the chuck 21 of the lifting device 2 is moved by the driving belt 23 and the motor 22 to a lowermost position (the position indicated by the imaginary lines and reference sign 21' in FIG. 4), the chuck 21 comes into contact with the cloth Y located at the terminal end of the supply conveyor 1 and holds the contact portion of the cloth Y. In addition, the portion of the cloth held by the chuck 21 may be an arbitrary portion. Furthermore, when the chuck 21 is moved upward, the chuck 21 is raised to a predetermined level (e.g., uppermost position) indicated by the solid lines in FIG. 4 while holding the cloth Y, so that the chuck 21 then holds the cloth Yin a hanging state. Here, two or more pieces of cloth Y may be held and lifted by the chuck 21.

Figure 4:
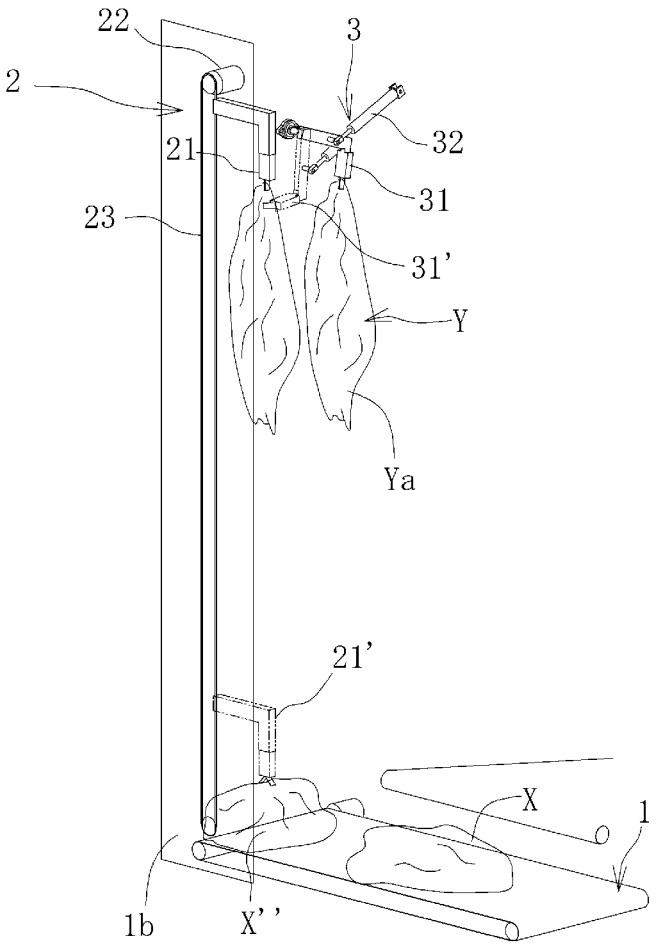
FIG. 4 is an enlarged perspective view of the supply conveyor and the lifting device of the automatic cloth spreading machine of FIG. 1.

As shown in FIG. 1 and FIG. 4, the temporary holding device 3 has a chuck 31 and a forward-backward moving device (extending-contracting cylinder 32) that moves the chuck 31 forward and backward in the front-rear direction. When the chuck 21 of the lifting device 2 moves to the uppermost position, or the cloth Y held by the chuck 21 at the uppermost position is detected by a sensor (not shown), the extending-contracting cylinder 32 of the temporary holding device 3 extends and moves the chuck 31 forward to the position indicated by the imaginary lines (indicated by reference sign 31') in FIG. 4, and the chuck 31 of the temporary holding device 3 receives a portion near an upper end of the cloth Y lifted by the lifting device 2. (At this point, the chuck 21 of the lifting device 2 releases the cloth Y.) Thereafter, the extending-contracting cylinder 32 contracts, so that the chuck 31 moves backward to a predetermined position as indicated by the solid lines in FIG. 4, with the cloth Y hanging from the chuck 31. In most cases, in addition, one of corner ends of the cloth appears at a lowermost end (indicated by reference sign Ya in FIG. 4) of the cloth Y hanging from the chuck 31.

As shown in FIG. 5 to FIG. 9, the corner end locating device 4 has: a chuck 41 that receives the cloth Y hung and held by the chuck 31 of the temporary holding device 3 at its backward position; a forward-backward moving device (extending-contracting cylinder 42) that moves the chuck 41 forward and backward in the front-rear direction; a platform 43 on an upper side of which the cloth Y is placed; a sensor 49, such as a photoelectric sensor, that detects a terminal end portion (corner end Ya) of the cloth Y being dragged over the platform 43; a pressing plate 47 that holds a central portion of the cloth Y on the platform 43 between the pressing plate 47 and the platform 43; an extending-contracting cylinder 48 that moves the pressing plate 47 upward and downward; a pair of corner end locating rollers 44, 45; and an extending-contracting cylinder 46 that moves the one corner end locating roller 45 closer to or separated from the other corner end locating roller 44.

Figure 5:
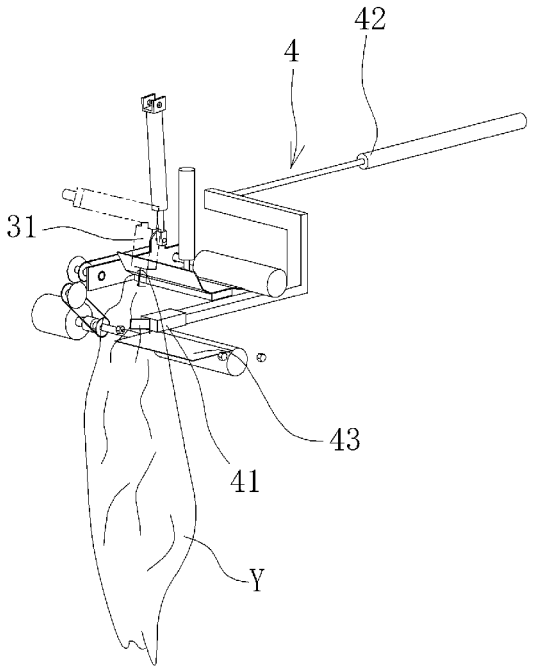
FIG. 5 is an enlarged perspective view of a temporary holding device and a corner end locating device of the automatic cloth spreading machine of FIG. 1.
Figure 6:
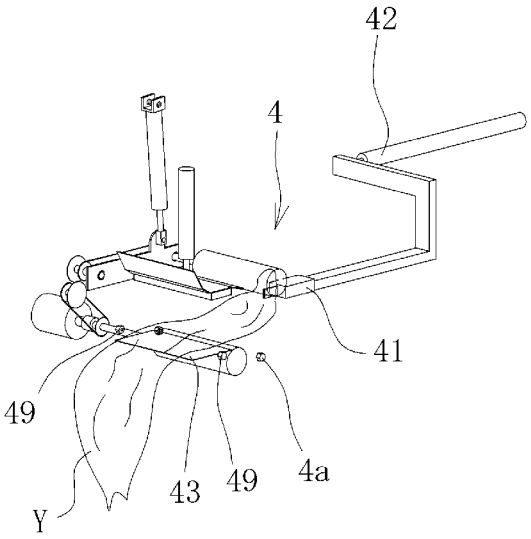
FIG. 6 is an enlarged perspective view of the corner end locating device of the automatic cloth spreading machine of FIG. 1.
Figure 7:
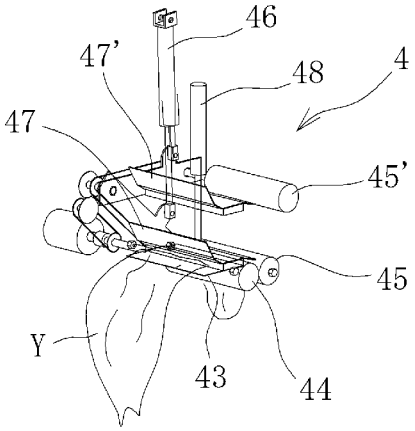
FIG. 7 is an enlarged perspective view of the corner end locating device of the automatic cloth spreading machine of FIG. 1.
Figure 8:
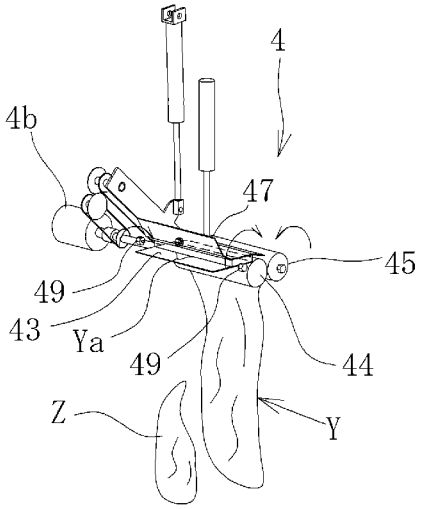
FIG. 8 is an enlarged perspective view of the corner end locating device of the automatic cloth spreading machine of FIG. 1.
Figure 9:
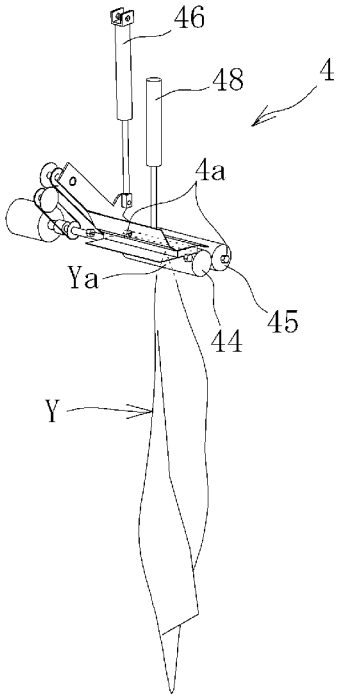
FIG. 9 is an enlarged perspective view of the corner end locating device of the automatic cloth spreading machine of FIG. 1.

When the chuck 31 of the temporary holding device 3 moves to the backward position while holding the cloth Y as shown in FIG. 5, the extending-contracting cylinder 42 of the corner end locating device 4 extends and moves the chuck 41 forward, and the chuck 41 receives the cloth Y from the chuck 31 of the temporary holding device 3. Subsequently, as shown in FIG. 6, the extending-contracting cylinder 42 contracts, so that the chuck 41, while holding the cloth Y, pulls the cloth Y a predetermined distance over the platform 43 before releasing the cloth Y. Then, as shown in FIG. 7, the corner end locating roller 45 located on a far side moves downward from the position indicated by reference sign 45' and holds a leading end portion of the cloth Y between the corner end locating roller 45 and the corner end locating roller 44 on a near side. The pressing plate 47 moves downward from the raised position indicated by reference sign 47' and holds a central portion of the cloth Y between the pressing plate 47 and the platform 43. In this state, as shown in FIG. 8, both the corner end locating rollers 44, 45 rotate in the arrow directions, so that the cloth Y droops. When the terminal end portion (forming the corner end Ya) of the cloth Y being dragged over the platform 43 is detected by the sensors 49, 49 (or when the cloth Y is not detected by the sensors 49, 49), the rotation speed of both the corner end locating rollers 44, 45 is adjusted to switch to a low speed. If there is a plurality of pieces of cloth Y, pieces of cloth Z other than one piece of cloth Y that is held at the terminal end portion between the platform 43 and the pressing plate 47, will fall in the course of this series of actions. Thereafter, when the terminal end portion (corner end Ya) of the cloth Y is detected by other sensors 4*a*, 4*a*, such as photoelectric sensors, that are disposed between both the corner locating rollers 44, 45 (or when the cloth Y is not detected by the sensors 49, 49), the corner end locating rollers 44, 45 stop rotating, and the corner end Ya or a portion near the corner end Ya of the cloth Y is tucked and held between the corner end locating rollers 44, 45, which completes a corner end locating task.

In the shown example, the cloth Y lifted by the lifting device 2 is temporarily held by the temporary holding device 3 and then handed over to the chuck 41 of the corner end locating device 4. In another example (not shown), the temporary holding device 3 may be omitted and the cloth Y lifted by the lifting device 2 may be directly held by the chuck 41 of the corner end locating device 4.

Figure 10:
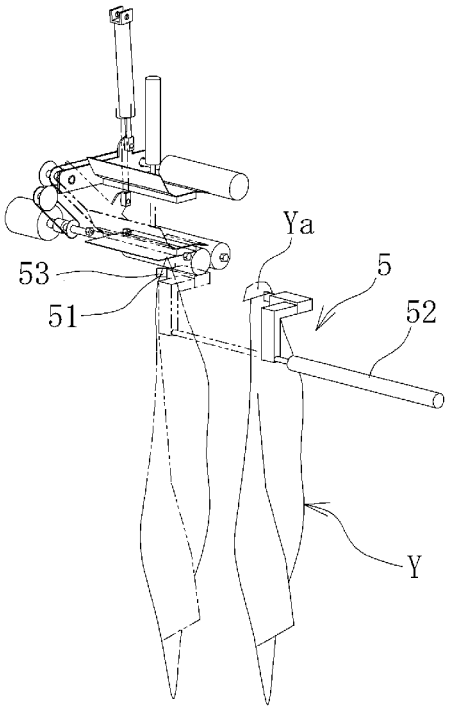
FIG. 10 is an enlarged perspective view of the corner end locating device and a corner end receiving device of the automatic cloth spreading machine of FIG. 1.

As shown in FIG. 10, the corner end receiving device 5 has a chuck 51 disposed under the corner end locating rollers 44, 45, and a forward-backward moving device (extending-contracting cylinder 52) that moves the chuck 51 forward and backward in the left-right direction (see FIG. 1) within a range directly under a contact portion of the corner end locating rollers 44, 45. When the corner end Ya or a portion near the corner end Ya of the cloth Y is being held by the pair of corner end locating rollers 44, 45 of the corner end locating device 4, the extending-contracting cylinder 52 of the corner end receiving device 5 extends and moves the chuck 51 forward in a leftward direction as indicated by the imaginary lines in FIG. 10. The chuck 51 holds the cloth Y at a position a little below the corner end Ya so that the chuck 51 moves backward toward the right side (toward the horizontal pulling device 6) with the cloth Y drooping from the chuck 51. A sensor 53 that detects the cloth Y is mounted on the chuck 51. The chuck 51 is activated upon the sensor 53 detecting that the chuck 51 has come close to the cloth Y, so that the chuck 51 can reliably hold the cloth Y.

A platform 64 is provided at a position in the immediate vicinity of a lower rear side of the chuck 51 in a state where the extending-contracting cylinder 52 of the corner end receiving device 5 is contracted. The platform 64 supports a terminal end side of the cloth Y when a portion near the upper end of the cloth (corner end Ya) is received and moved backward by the horizontal pulling device 6 to be described next.

In addition, in this embodiment, to reveal one corner end Ya of the rectangular cloth Y, the lifting device 2, the temporary holding device 3, and the corner end locating device 4 are used such that the corner end of the cloth Y in a balled-up state can be automatically located. Alternatively, this cloth corner end locating task may be performed, for example, by a worker manually finding one corner end of a balled-up piece of cloth Y. In this case, the worker may manually have the found corner end Ya of the cloth received by the chuck 51 of the corner end receiving device 5 or directly received by a chuck 61 of the horizontal pulling device 6 to be described below.

Figure 11:
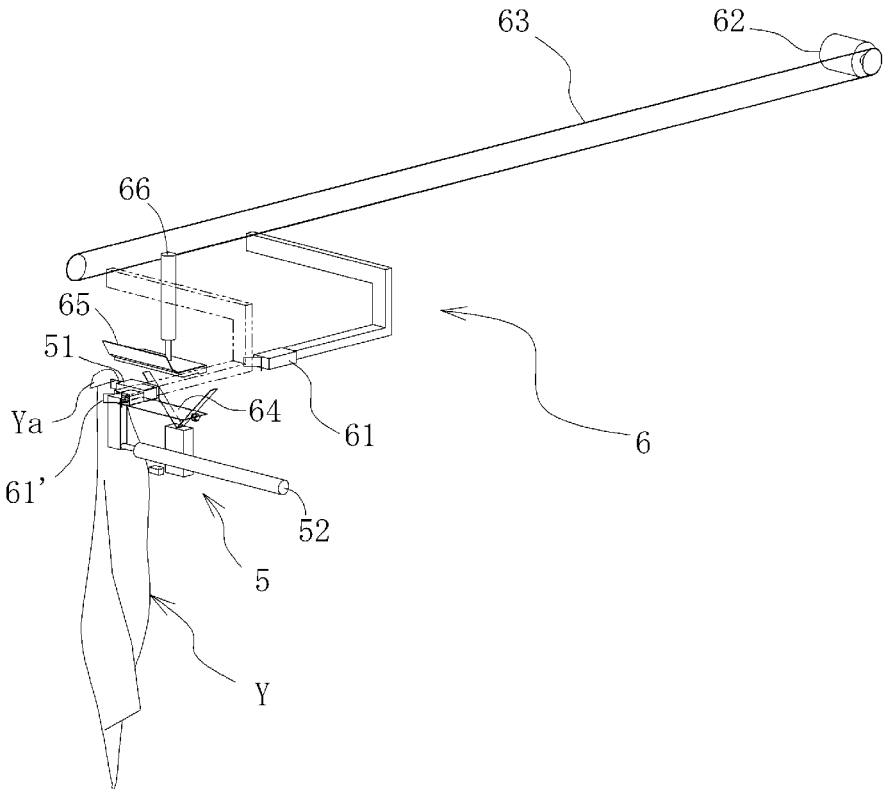
FIG. 11 is an enlarged perspective view of the corner end receiving device and a horizontal pulling device of the automatic cloth spreading machine of FIG. 1.
Figure 12:
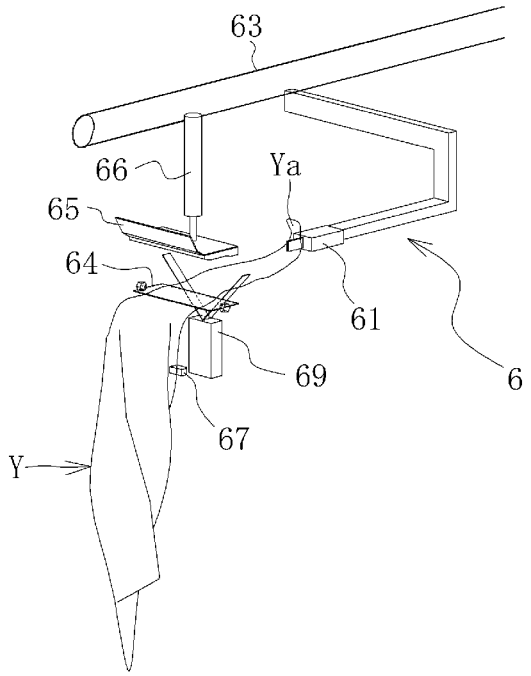
FIG. 12 is an enlarged perspective view of the horizontal pulling device of the automatic cloth spreading machine of FIG. 1.
Figure 13:
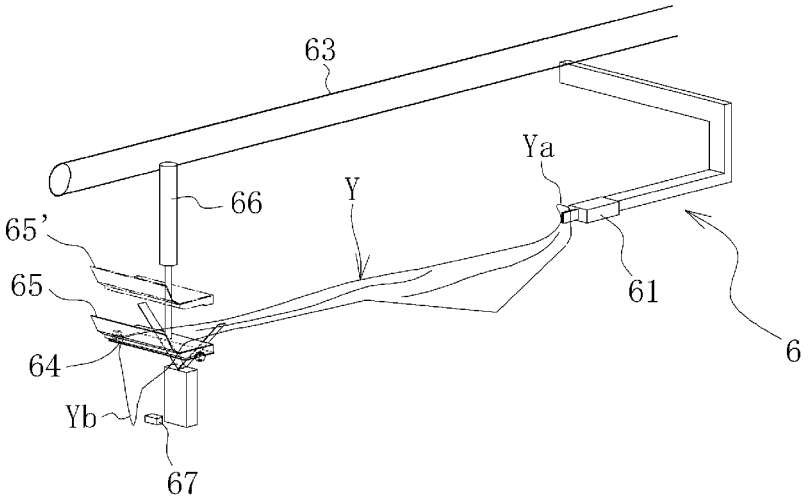
FIG. 13 is an enlarged perspective view of the horizontal pulling device of the automatic cloth spreading machine of FIG. 1.
Figure 14:
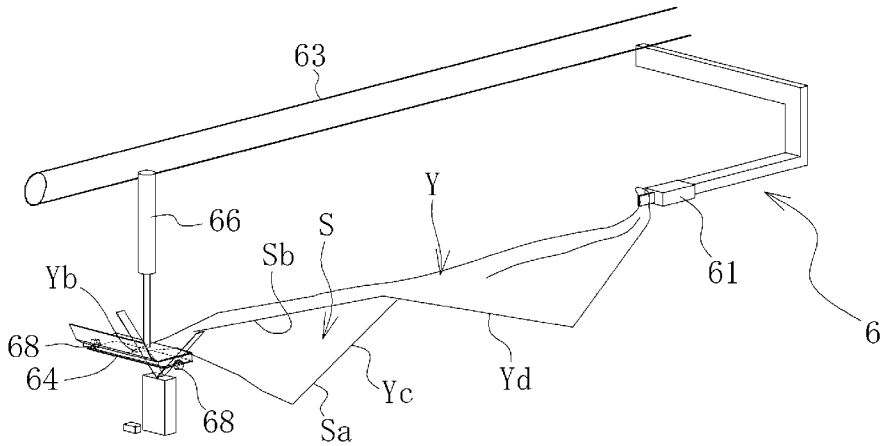
FIG. 14 is an enlarged perspective view of the horizontal pulling device of the automatic cloth spreading machine of FIG. 1.

As shown in FIG. 11 to FIG. 14, the horizontal pulling device 6 has the chuck 61 and a forward-backward moving device that moves the chuck 61 forward and backward in the front-rear direction. In the shown example, the forward-backward moving device has a driving belt 63 that holds the chuck 61, and a motor 62 that moves the chuck 61 forward and backward in the front-rear direction by rotating a pulley around which the driving belt 63 is wrapped. However, the forward-backward moving device may have any structure and, for example, an extending-contracting cylinder can also be used. As shown in FIG. 11, when the chuck 51 of the corner end receiving device 5 holds the cloth Y and moves backward, the chuck 61 of the horizontal pulling device 6 moves forward to the position indicated by the imaginary lines and reference sign 61', and the chuck 61' at this forward position holds the cloth at a position a little below the upper end portion (corner end Ya). Subsequently, after the chuck 51 of the corner end receiving device 5 releases the cloth Y, as shown in FIG. 12, the chuck 61 is moved backward while holding a portion near the corner end Ya of the cloth to thereby pull the cloth Y horizontally over the platform 64. Then, as shown in FIG. 13, after the cloth Y is horizontally pulled a predetermined distance, an upper pressing plate 65 is moved downward by a cylinder 66 from the raised position indicated by reference sign 65' and holds the cloth Y between the upper pressing plate 65 and the platform 64. Also thereafter horizontal pulling continues, and when a sensor 67 disposed under the platform 64 detects a terminal end portion Yb of the cloth Y (or when the cloth Y is not detected by the sensor 67), the speed of horizontal pulling is switched to a low speed. Then, as shown in FIG. 14, when another sensor 68, such as a photoelectric sensor, disposed near the platform 64 detects the terminal end portion Yb of the cloth Y (or when the cloth Y is not detected by the sensor 68), horizontal pulling is stopped. Thus, the rectangular cloth Y has been folded with the side edge Yc on the side to be located in a later step and the opposite side edge Yd intersecting each other so as to reveal a right-angled triangular part S of which an adjacent side Sa is formed by a portion of the side edge Yc that is adjacent to the corner of intersection while a hypotenuse Sb is formed by a portion of the opposite side edge Yd that defines the corner of intersection with the adjacent side Sa.

Figure 15:
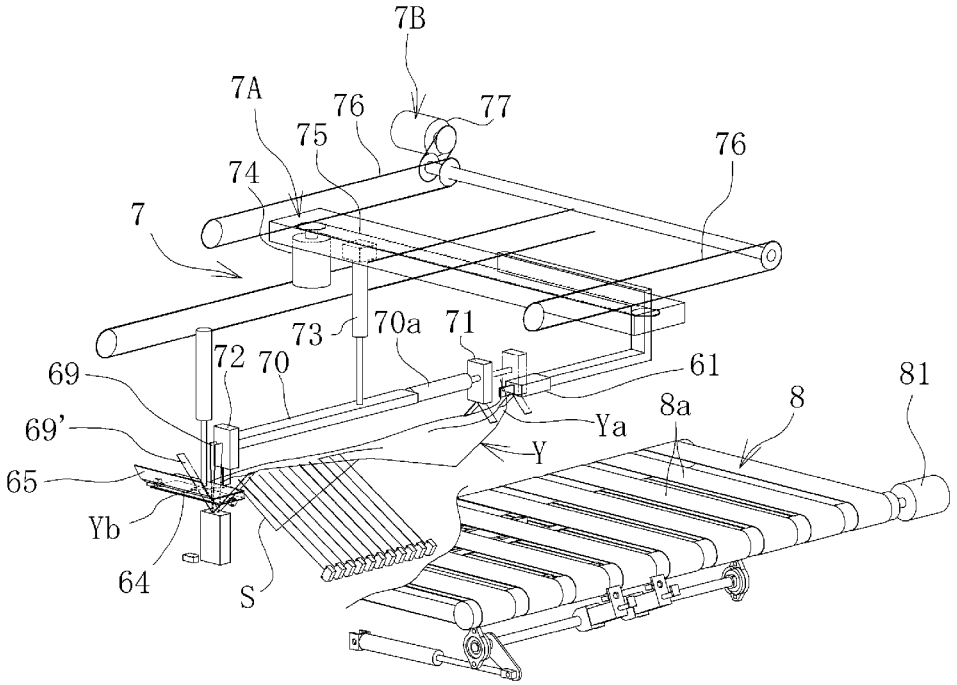
FIG. 15 is an enlarged perspective view of the horizontal pulling device, a two-position holding device, an edge locating conveyor, a moving mechanism as position changing means, and a vertically inverting device of the automatic cloth spreading machine of FIG. 1.

As shown in FIG. 15, the edge locating conveyor 8 that is driven by a motor 81 is installed to the right of the platform 64 and the upper pressing plate 65. The edge locating conveyor 8 is formed by a plurality of (in the shown example, nine) thin belts **8*a* extending in the left-right direction indicated in FIG. 1 that is disposed at intervals in the front-rear direction indicated in FIG. 1**.

As shown in FIG. 15 to FIG. 20, the two-position holding device 7 has: a pair of holding chucks 71, 72 mounted at a rear end and a front end, respectively, of a coupling rod 70 that extends in the front-rear direction; an upward-downward moving cylinder 73 that moves both the holding chucks 71, 72 upward and downward at the same time; and a forward-backward moving device 7A that moves the holding chucks 71, 72 along with the upward-downward moving cylinder 73 forward and backward in the left-right direction indicated in FIG. 1. The forward-backward moving device 7A has a driving belt 75 that holds the upward-downward moving cylinder 73 in a vertical state, and a motor 74 that rotates a pulley around which the driving belt 75 is wrapped. However, the forward-backward moving device 7A may have any structure as long as it can move the holding chucks 71, 72 in the left-right direction, and a forward-backward moving cylinder may also be used. In this embodiment, a moving mechanism 7B is provided as a position changing means that moves the two-position holding device 7 in a crosswise direction (the front-rear direction indicated in FIG. 1) relative to the delivery direction of the edge locating conveyor 8. The moving mechanism 7B has a driving belt 76 on which the forward-backward moving device 7A is fixed, and a motor 77 that moves the two-position holding device 7 along with the forward-backward moving device 7A forward and backward in the front-rear direction by rotating a pulley around which the driving belt 76 is wrapped. However, the moving mechanism 7B may have any structure as long as it can move the two-position holding device 7 in the crosswise direction relative to the delivery direction of the edge locating conveyor 8, and a forward-backward moving cylinder may also be used. As shown only in FIG. 15, the coupling rod 70 is provided with a cylinder **70*a* as an interval changing mechanism that changes the distance between the holding chucks 71, 72 according to the size of the cloth Y to be handled etc. In a preferable configuration, whether or not operation of the cylinder 70*a* is required and the amount of operation thereof are automatically determined by the controller (not shown) in association with the pulling distance in the horizontal pulling device 6**, and operation is performed accordingly.

As shown in FIG. 15, the front-side holding chuck 72 is located at a position at which it can hold the front-side end portion (corner end) Yb of the cloth Y laid by the horizontal pulling device 6, while the rear-side holding chuck 71 is located at a position at which it can hold an appropriate portion of the laid cloth Y, on the rear side of the front-side end portion Yb.

In its contracted state, the upward-downward moving cylinder 73 is configured such that the upward-downward moving cylinder 73 keeps the holding chucks 71, 72 on standby at positions above the cloth Y having been horizontally pulled, and in its extended state shown in FIG. 15, the upward-downward moving cylinder 73 moves the holding chucks 71, 72 downward to positions at which they can hold the ridge of the fold in the cloth Y or a portion near the ridge. When the two-position holding device 7 moves downward as the upward-downward moving cylinder 73 extends, the front-side holding chuck 72 holds the front-side end portion (corner end) Yb of the cloth Y while the rear-side holding chuck 71 holds an appropriate rear-side portion of the cloth Y. Here, the opening degree of the chuck 69 provided near the rear side of the upper pressing plate 65 can be reduced from the wide-open state indicated by reference sign 69' to help the front-side holding chuck 72 hold the cloth Y. When the cloth Y is held by the holding chucks 71, 72, the cloth Y is released from the chuck 61, the upper pressing plate 65, and the chuck 69 of the horizontal pulling device 6 that have been holding or restraining the cloth Y. Thus, the holding chucks 71, 72 hold two separate portions of the rectangular cloth Y that are on or near the ridge of the fold, in a state where the cloth Y has been folded with the side edge Yc on the side to be located in a later step and the opposite side edge Yd intersecting each other so as to reveal the right-angled triangular part S of which the adjacent side Sa is formed by the portion of the side edge Yc that is adjacent to the corner of intersection while the hypotenuse Sb is formed by the portion of the opposite side edge Yd that defines the corner of intersection with the adjacent side Sa. In addition, in this embodiment, the two-position holding device 7 is configured to be able to automatically hold two separate portions of the cloth Y that are on or near the ridge of the fold after the cloth Y has undergone the processing by each of the corner end receiving device 5 and the horizontal pulling device 6. However, the processing leading up to the holding chucks 71, 72 of the two-position holding device 7 holding the cloth Y may be performed by using devices different from those shown in the drawings or may be manually performed by a worker.

Figure 16:
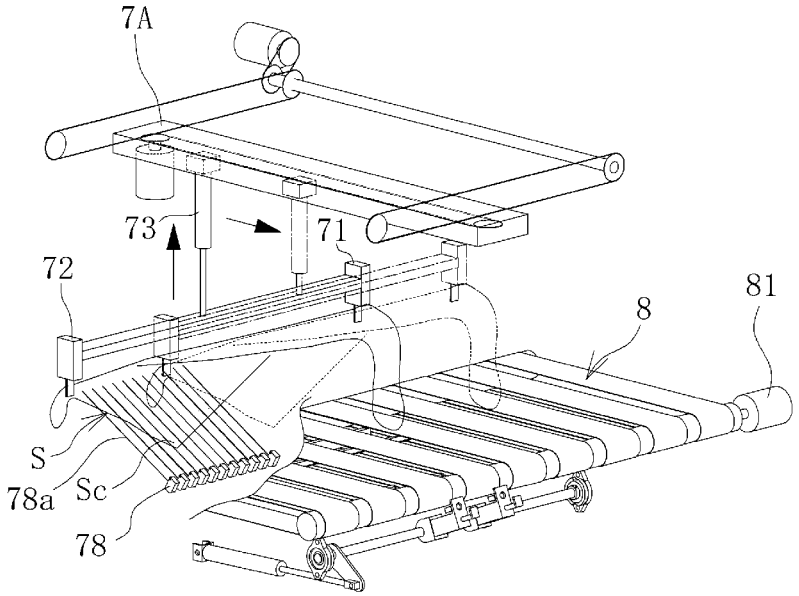
FIG. 16 (*a*) and FIG. 16 (*b*) are a perspective view and a front view, respectively, showing how a right-angled portion of a right-angled triangular part of cloth is detected by a sensor when the two-position holding device is moved toward an upper side and a right side from the state shown in FIG. 15.
Figure 16:
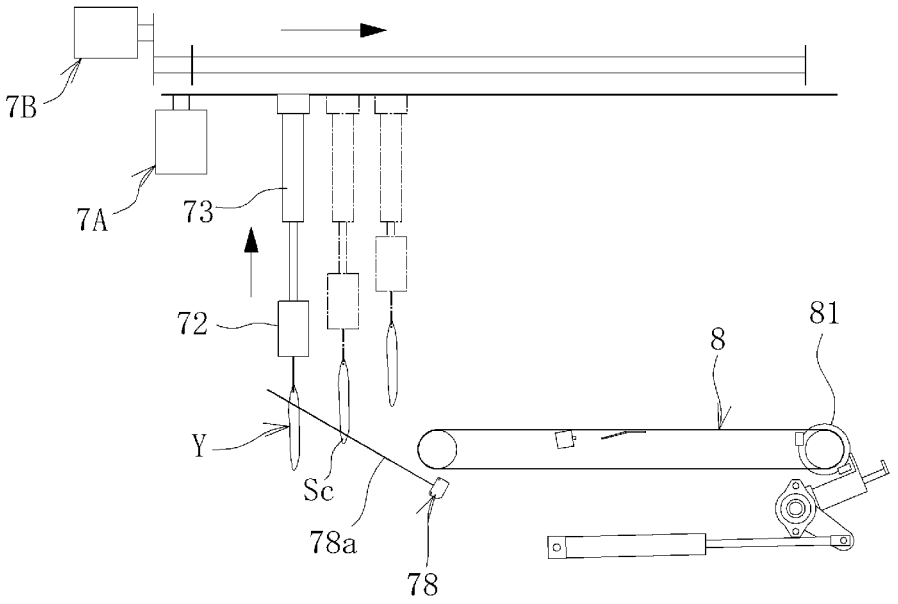
Figure 17:
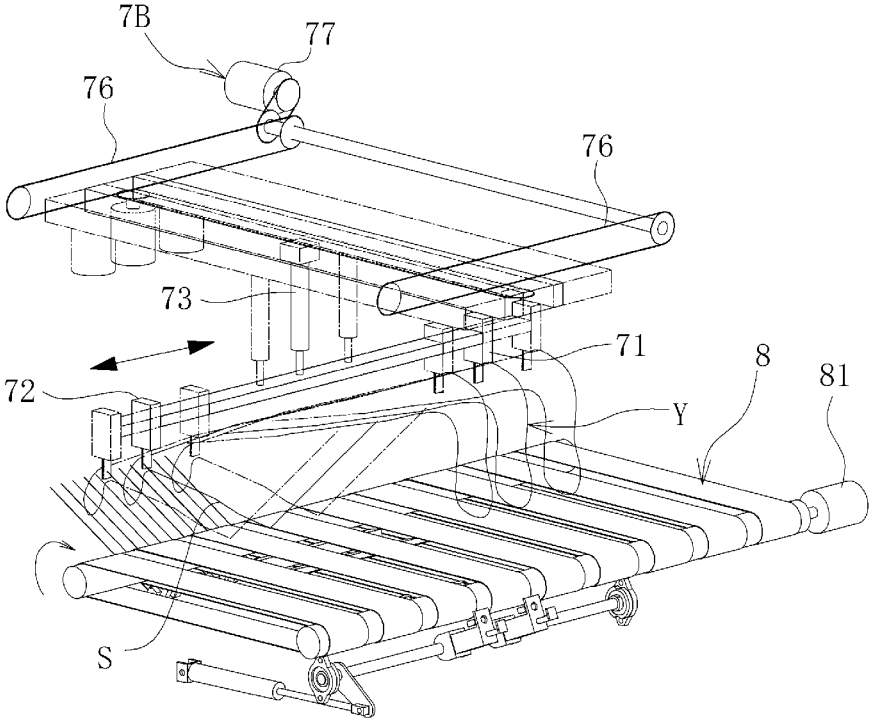
FIG. 17 is a perspective view showing how the two-position holding device is moved from the state shown in FIG. 16 in a crosswise direction relative to a delivery direction of the edge locating conveyor as the moving mechanism as the position changing means is operated.

Subsequently, as shown in FIG. 16 (*a*) and FIG. 16 (*b*), the holding chucks 71, 72 of the two-position holding device 7 are moved toward the upper side and the right side and disposed directly above the edge locating conveyor 8 as the upward-downward moving cylinder 73 contracts and the forward-backward moving device 7A operates. Here, a sensor 78 that is provided under the edge locating conveyor 8 detects the position of a right-angled portion Sc of the right-angled triangular part S. The sensor 78 is composed of, for example, a plurality of photoelectric sensors (reference sign 78*a* in FIG. 16 indicates an optical axis of the sensor) that is arrayed in the crosswise direction relative to the delivery direction of the edge locating conveyor 8, and the position of one of the photoelectric sensors that has detected the cloth to the end can be regarded as the position of the right-angled portion Sc. Based on the position of the right-angled portion Sc detected by the sensor 78, the controller (not shown) obtains an amount of positional deviation of the right-angled triangular part S from a correct clamping position corresponding to the positions of clamping chucks 92, 93 to be described later. To compensate for this amount of positional deviation, the controller operates the moving mechanism 7B described above as the position changing means so as to shift the two-position holding device 7 in the crosswise direction relative to the delivery direction of the edge locating conveyor 8 as shown in FIG. 17. Thus, the right-angled triangular part S of the cloth Y held by the two-position holding device 7 is adjusted so as to be located at the correct clamping position corresponding to the positions of the clamping chucks 92, 93 to be described later. The sensor 78 is not limited to an optical sensor, and for example, may also be an image sensor that takes an image of the right-angled triangular part S by a CCD camera or the like and recognizes the right-angled portion Sc by image processing.

Figure 18:
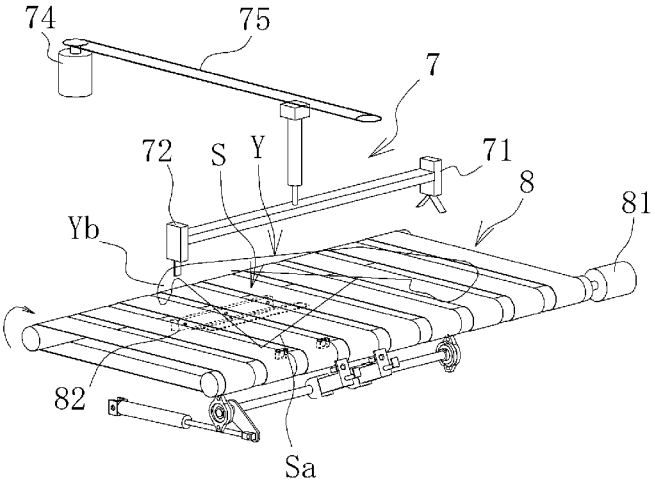
FIG. 18 is an enlarged perspective view of the two-position holding device, the edge locating conveyor, and the vertically inverting device of the automatic cloth spreading machine of FIG. 1.

The belts of the edge locating conveyor 8 are rotating in the direction of the arrow in FIG. 18. The right-angled portion Sc of the cloth Y is located near an upper surface of a belt of the edge locating conveyor 8 or at a position at which the right-angled portion Sc comes into contact with the upper surface. Air blown by a blowing device 82 installed between upper and lower portions of the belts of the edge locating conveyor 8 causes the right-angled triangular part S to trail in the delivery direction of (move along) the conveyor 8.

Figure 19:
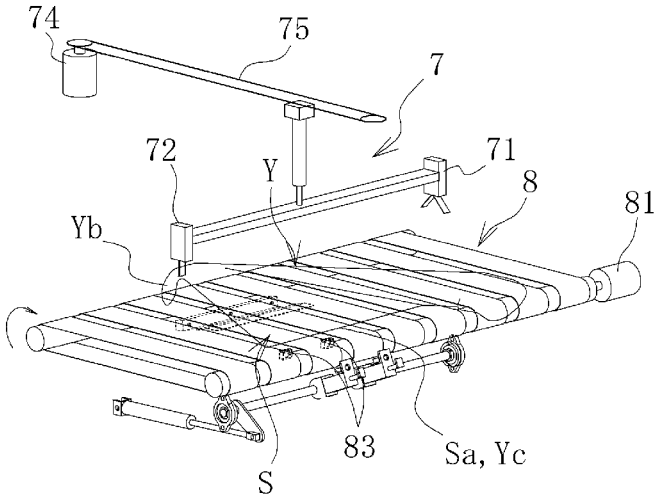
FIG. 19 is an enlarged perspective view of the two-position holding device, the edge locating conveyor, and the vertically inverting device of the automatic cloth spreading machine of FIG. 1.
Figure 20:
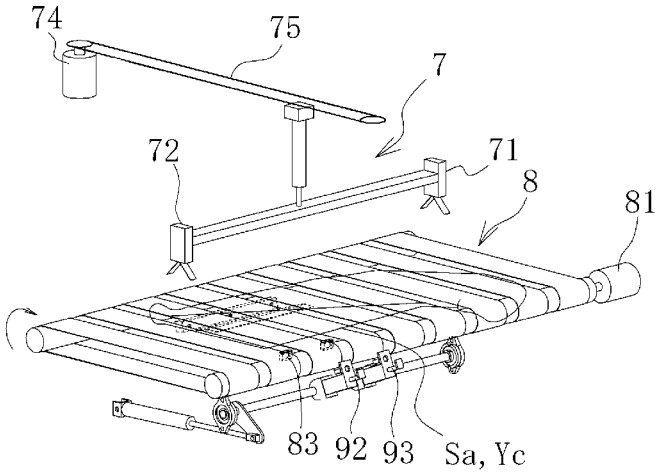
FIG. 20 is an enlarged perspective view of the two-position holding device, the edge locating conveyor, and the vertically inverting device of the automatic cloth spreading machine of FIG. 1.

Next, as shown in FIG. 19, the two-position holding device 7 releases the two portions of the cloth Y being held at such timings that the portion on the side of the right-angled triangular part S is released later, i.e., that in the shown example, the cloth Y is released first by the rear-side holding chuck 71 and then by the front-side holding chuck 72. Thus, as a portion of the cloth Y that has first fallen onto the edge locating conveyor 8 flows toward a downstream side, the cloth Y rotates in the plane of the edge locating conveyor 8 with the front-side holding chuck 72 serving as a base point. This results in a positional relationship in which the adjacent side Sa of the right-angled triangular part S of the cloth Y is at a substantially right angle to the delivery direction of the edge locating conveyor 8. When this positional relationship is established, as shown in FIG. 20, the other holding chuck 72 releases the cloth Y, so that the entire cloth Y falls onto the edge locating conveyor 8, which completes locating of the edge of the cloth Y. For example, two optical sensors 83 that detect the adjacent side Sa (side edge Yc) of the right-angled triangular part S of the cloth Y being delivered on the edge locating conveyor 8 are installed near a downstream end of the edge locating conveyor 8, and the edge locating conveyor 8 may be switched to a low speed when the sensors 83 detect the cloth Y.

Figure 21:
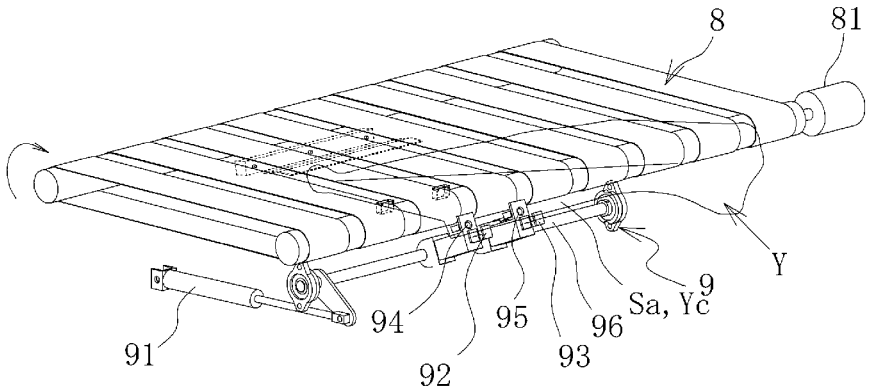
FIG. 21 is an enlarged perspective view of the edge locating conveyor and the vertically inverting device of the automatic cloth spreading machine of FIG. 1.
Figure 22:
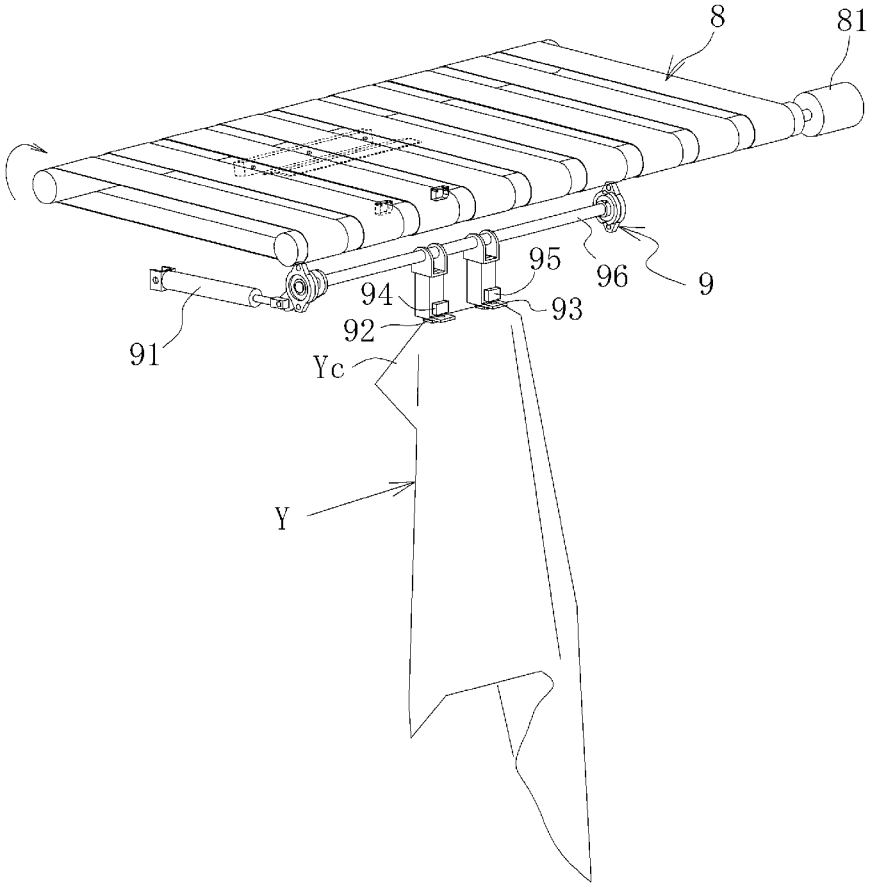
FIG. 22 is an enlarged perspective view of the edge locating conveyor and the vertically inverting device of the automatic cloth spreading machine of FIG. 1.

As shown in FIG. 21, the vertically inverting device 9 has: for example, two clamping chucks 92, 93 that are disposed near the downstream end of the edge locating conveyor 8 in the delivery direction and clamp a peripheral portion of the right-angled triangular part S of the cloth Y including the adjacent side Sa (a portion of the side edge Yc); two optical sensors 94, 95 provided near the clamping chucks 92, 93; a reversing shaft 96 that supports the clamping chucks 92, 93; and a turning cylinder 91 that turns the reversing shaft 96 through a link. In addition, any mechanism may be used as long as it can reverse the cloth Y clamped by the two clamping chucks 92, 93, and instead of the turning cylinder 91, a motor that rotates the reversing shaft 96 in normal and reverse directions may also be used. The two clamping chucks 92, 93 may be configured to move independently of each other based on signals output by the sensors 94, 95 upon detecting the side edge Yc of the cloth Y. In this case, even when the direction of the adjacent side Sa of the right-angled triangular part S of the cloth Y being delivered by the edge locating conveyor 8 deviates significantly from the direction of a right angle to the delivery direction of the edge locating conveyor 8, the adjacent side Sa of the right-angled triangular part S of the cloth Y can be clamped straight between the clamping chucks 92, 93 by shifting the clamping timings of the clamping chucks 92, 93 so as not to coincide with each other.

The vertically inverting device 9 operates as follows. First, until the adjacent side Sa of the right-angled triangular part S of the cloth Y being transferred on the edge locating conveyor 8 is detected by the sensors 94, 95, each of the clamping chucks 92, 93 remains on standby in a substantially horizontal (slightly upward-inclined) posture as shown in FIG. 20. When the adjacent side Sa of the right-angled triangular part S of the cloth Y being transferred on the edge locating conveyor 8 is detected by the sensors 94, 95, each of the clamping chucks 92, 93 holds a peripheral portion of the right-angled triangular part S of the cloth Y including the adjacent side Sa based on detection signals from the sensors 94, 95. Immediately thereafter, the turning cylinder 91 contracts and causes each of the clamping chucks 92, 93 to turn downward at a high speed while holding the peripheral portion (side edge Yc) of the adjacent side Sa of the right-angled triangular part S and to assume the downward-facing posture shown in FIG. 22. Here, the cloth Y having been held by each of the clamping chucks 92, 93 is rapidly swung down and thereby an unfolding action is exerted on the cloth Y in a short-side direction. Each of the clamping chucks 92, 93 holding the side edge Yc of the cloth Y in the downward-facing posture releases the peripheral portion of the side edge Yc they are clamping after this peripheral portion is passed to each of chucks 111, 112 of the hanging device 11 to be described below, and immediately thereafter are turned upward and returned to the original standby positions.

Thus, the two-position holding device 7, the edge locating conveyor 8, and the clamping chucks 92, 93 work together to constitute the edge clamping device that locates an edge of cloth Y and clamps a peripheral portion of the right-angled triangular part S including the located adjacent side Sa.

Figure 23:
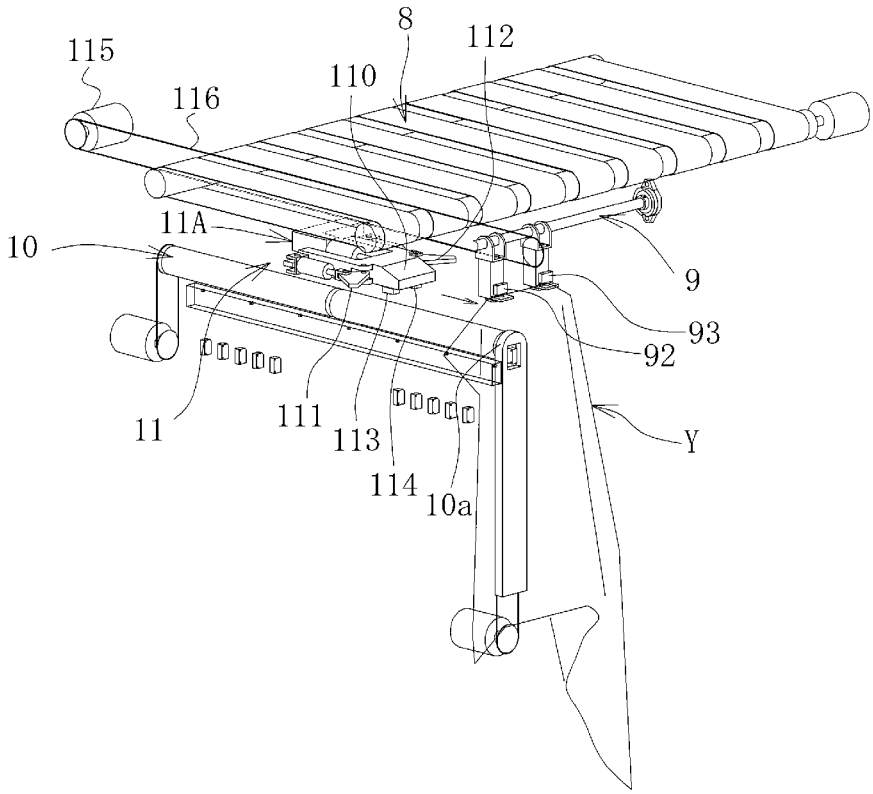
FIG. 23 is an enlarged perspective view of the edge locating conveyor, the vertically inverting device, a roller, and a hanging device of the automatic cloth spreading machine of FIG. 1.

Next, as shown in FIG. 23, the roller 10 and the hanging device 11 that hangs the cloth Y received from the vertically inverting device 9 onto the roller 10 are installed directly under a front-side portion of the edge locating conveyor 8, in a positional relationship with the hanging device 11 located above the roller 10.

The hanging device 11 has a hanging movable body 11A, and the hanging movable body 11A has a forward-backward moving platform 110 facing the vertically inverting device 9, the two chucks 111, 112 that are disposed on both sides of the forward-backward moving platform 110 and receive the cloth Y from the clamping chucks 92, 93 of the vertically inverting device 9, and chuck sensors 113, 114. The hanging movable body 11A is moved forward and backward in the left-right direction (in the direction of a rotational axis of the roller 10) by a forward-backward moving device. In the shown example, the forward-backward moving device is composed of a driving belt 116 that holds the hanging movable body 11A and a motor 115 that rotates a pulley around which the driving belt 116 is wrapped. However, the forward-backward moving device may have any structure as long as it can move the chucks 111, 112 forward and backward in the left-right direction, and, for example, a forward-backward moving cylinder may also be used.

Figure 24:
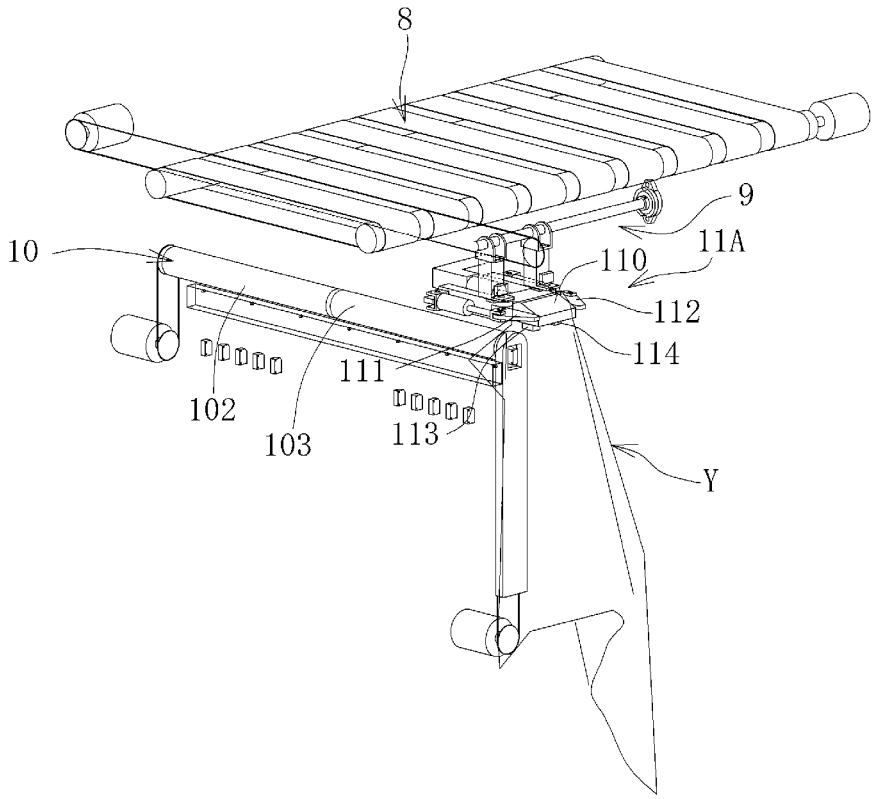
FIG. 24 is an enlarged perspective view of the edge locating conveyor, the vertically inverting device, the roller, and the hanging device of the automatic cloth spreading machine of FIG. 1.
Figure 25:
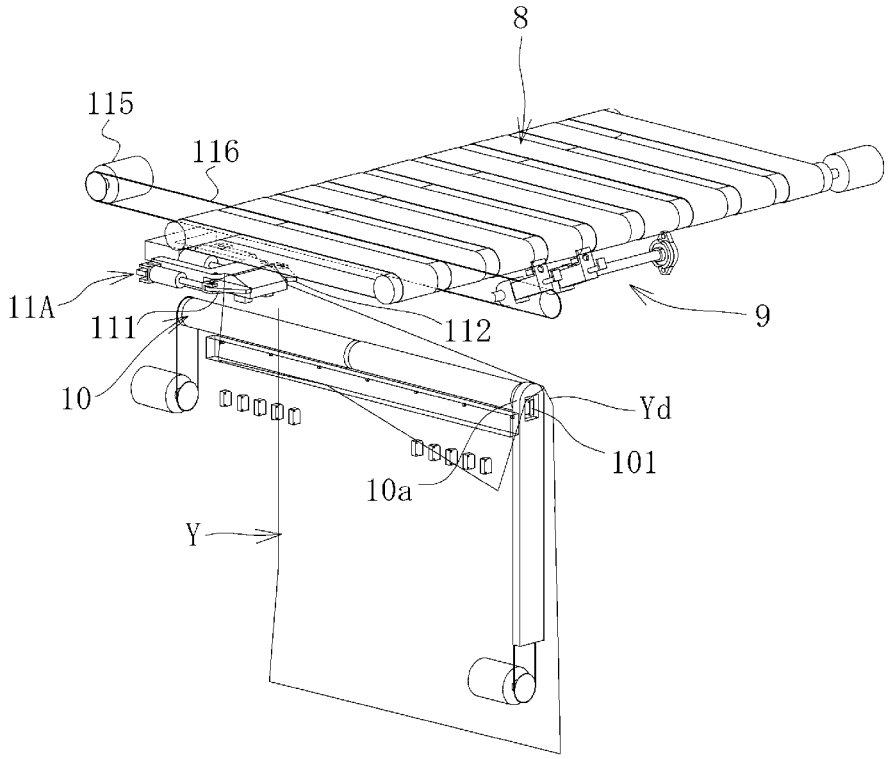
FIG. 25 is an enlarged perspective view of the edge locating conveyor, the vertically inverting device, the roller, and the hanging device of the automatic cloth spreading machine of FIG. 1.

The hanging movable body 11A moves from the standby position shown in FIG. 23 to a predetermined forward position beyond one end (in FIG. 23, the right-side end) of the roller 10 in an axial direction so as to come closer to the cloth Y held by the vertically inverting device 9. As shown in FIG. 24, when the chuck sensors 113, 114 detect the cloth Y, the chucks 111, 112 are closed toward both sides of the forward-backward moving platform 110 and hold the cloth Y. Here, the position at which the chucks 111, 112 hold the cloth Y is a position near the position at which the clamping chucks 92, 93 of the vertically inverting device 9 hold the cloth Y. In addition, the two chucks 111, 112 may be configured to move separately and independently, and in that case, the portion of the side edge Yc of the cloth Y between the two chucks 111, 112 can be held straighter. As shown in FIG. 25, after passing the cloth Y, the vertically inverting device 9 turns around and returns to the original position, and moves away from the path of the hanging movable body 11A. Since the roller 10 is disposed such that the rotational axis thereof is parallel to the forward-backward moving direction of the hanging movable body 11A, when the hanging movable body 11A holding the cloth Y in a drooping state moves backward, as shown in FIG. 25, the cloth Y is hung on the roller 10 and droops from the roller 10. Here, a side edge Yd on the opposite side from the long-side edge Yc held by the chucks 111, 112 is detected by a sensor 101, and the chucks 111, 112 release the cloth Y after a predetermined time has elapsed since the detection. The predetermined time is appropriately set such that the chucks 111, 112 release the cloth Y when the center of the cloth Y in a width direction thereof substantially coincides with the center of the roller 10 in a width direction thereof. In addition, the hanging device 11 continues to move backward a predetermined distance also after the chucks 111, 112 release the cloth Y.

Figure 26:
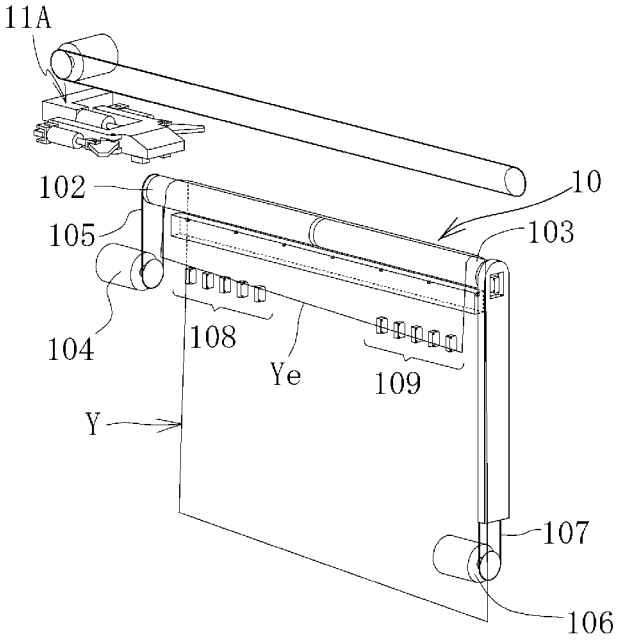
FIG. 26 is an enlarged perspective view of the roller and a hanging movable body of the automatic cloth spreading machine of FIG. 1.
Figure 27:
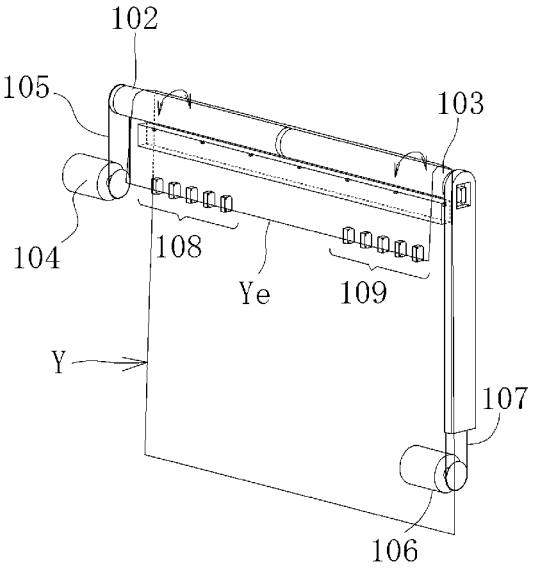
FIG. 27 is an enlarged perspective view of the roller of the automatic cloth spreading machine of FIG. 1.

As shown in FIG. 26, the roller 10 is composed of a first roller part 102 and a second roller part 103 disposed next to each other on the same axis. The first roller part 102 is connected to a motor 104 through a driving belt 105 and driven to rotate by the motor 104. The second roller part 103 is connected to a motor 106 through a driving belt 107 and driven to rotate by the motor 106. The rotation directions and the rotation speeds of the motors 104, 106 can be controlled separately and independently. It is preferable that the rotation directions and the rotation speeds of the motors 104, 106 be controlled separately and independently such that the direction of the cloth Y on the roller 10 can be corrected to the right direction (e.g., a direction in which a long-side direction of the cloth Y coincides with the front-rear direction) based on detection signals from a plurality of sensor groups 108, 109 that is arrayed under each of the roller parts 102, 103 parallel to the rotational axis of the rollers as shown in FIG. 27. For example, when the cloth Y is obliquely hung on the roller 10 as shown in FIG. 26, and only one sensor group 108 or 109 of the sensor groups 108, 109, or only some sensors of the sensor group 108 or 109 detect the short-side edge Ye of the cloth Y, the first roller part 102 and the second roller part 103 are repeatedly stopped, rotated in a normal direction, and rotated in a reverse direction based on a detection result of that sensor group or those sensors, until the side-edge Ye becomes parallel to the sensor groups 108, 109 and both the sensor groups 108, 109 detect the short-side edge Ye of the cloth Y at the same time. In addition, in the shown example, each of the sensor groups 108, 109 consists of five sensors respectively. However, the number of the sensors is not limited to five, and four or less or six or more sensors may be provided according to the width of the cloth Y to be processed, and the sensors to be activated may be switched according to the cloth Y to be processed.

Figure 28:
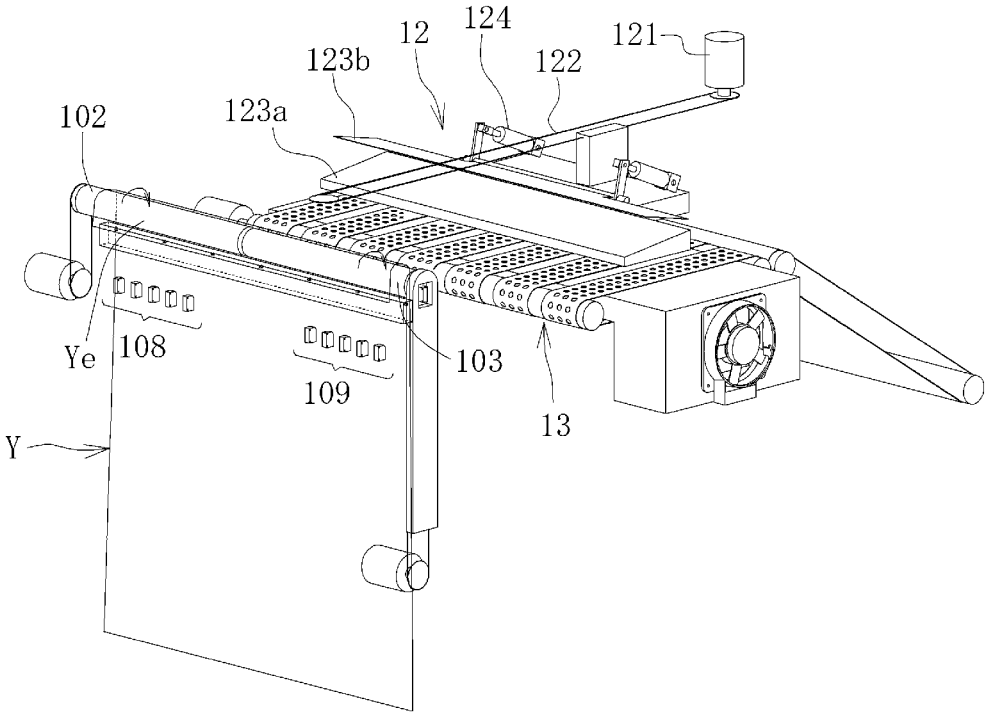
FIG. 28 is an enlarged perspective view of the roller, a forward-backward moving device, and a transfer conveyor of the automatic cloth spreading machine of FIG. 1.

The forward-backward moving device 12 moves the cloth Y having been oriented in the right direction on the roller 10 onto the transfer conveyor 13 and spreads the cloth Y. As shown in FIG. 28, the forward-backward moving device 12 has a holding unit that has a clamping width larger than the maximum width of a plurality of types of cloth Y to be processed and clamps a short-side end portion of the cloth Y, and a forward-backward moving mechanism that moves the holding unit forward and backward in the front-rear direction. In the shown example, the above holding unit is composed of a holding platform 123*a* inclined facing the roller 10, and a holding plate 123*b* that is opened from and closed onto the holding platform 123*a* by a cylinder 124 or the like. Furthermore, the above forward-backward moving mechanism is composed of a driving belt 122 that is coupled to the holding platform 123*a* and a motor 121 that rotates a pulley around which the driving belt 122 is wrapped. However, a forward-backward moving cylinder may also be used for the forward-backward moving mechanism.

Figure 29:
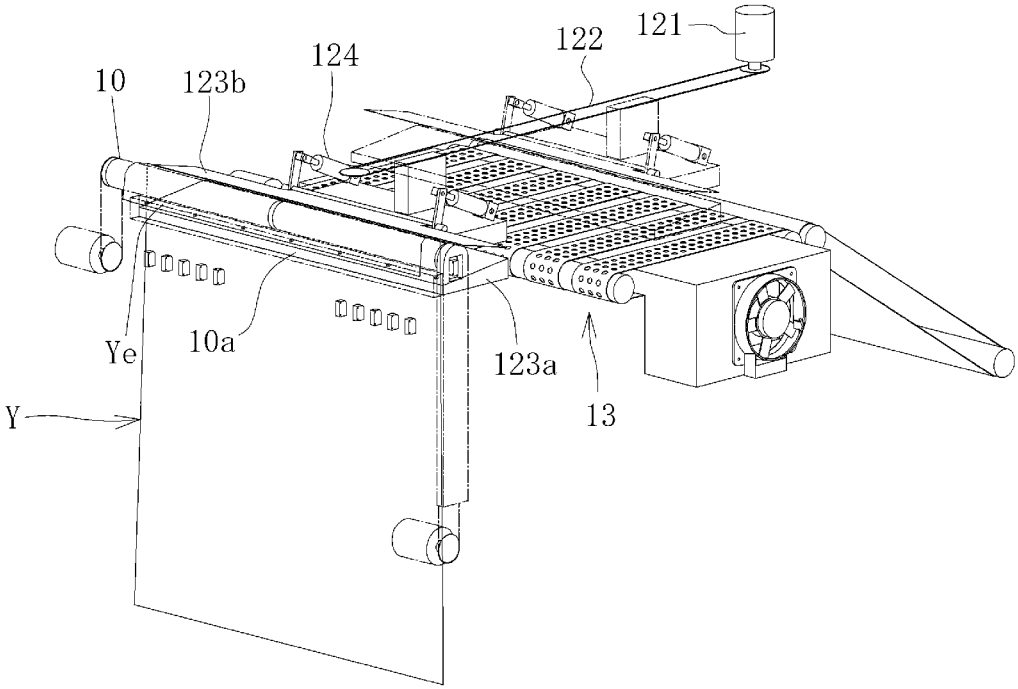
FIG. 29 is an enlarged perspective view of the roller, the forward-backward moving device, and the transfer conveyor of the automatic cloth spreading machine of FIG. 1.
Figure 30:
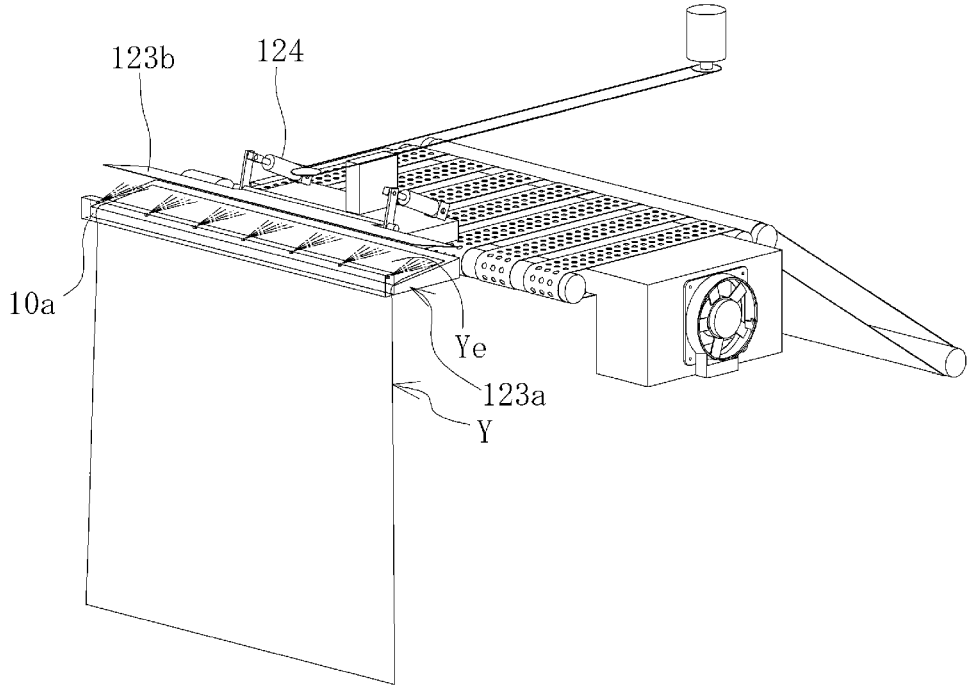
FIG. 30 is an enlarged perspective view of the forward-backward moving device and the transfer conveyor of the automatic cloth spreading machine of FIG. 1.
Figure 31:
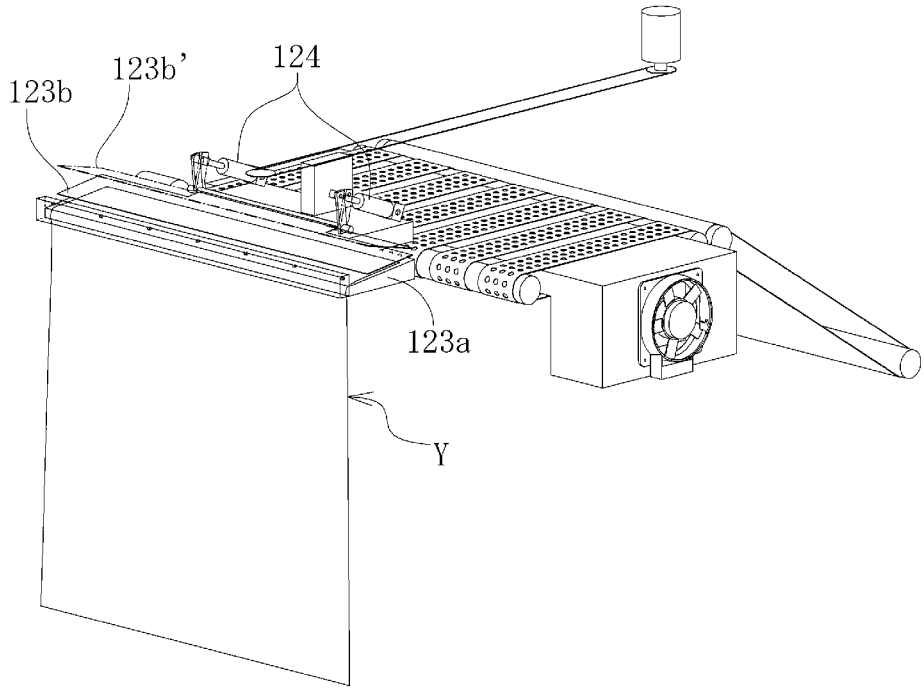
FIG. 31 is an enlarged perspective view of the forward-backward moving device and the transfer conveyor of the automatic cloth spreading machine of FIG. 1.
Figure 32:
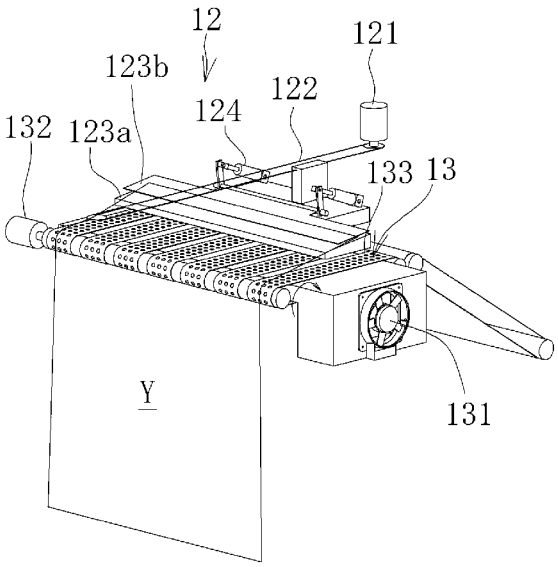
FIG. 32 is an enlarged perspective view of the forward-backward moving device and the transfer conveyor of the automatic cloth spreading machine of FIG. 1.
Figure 33:
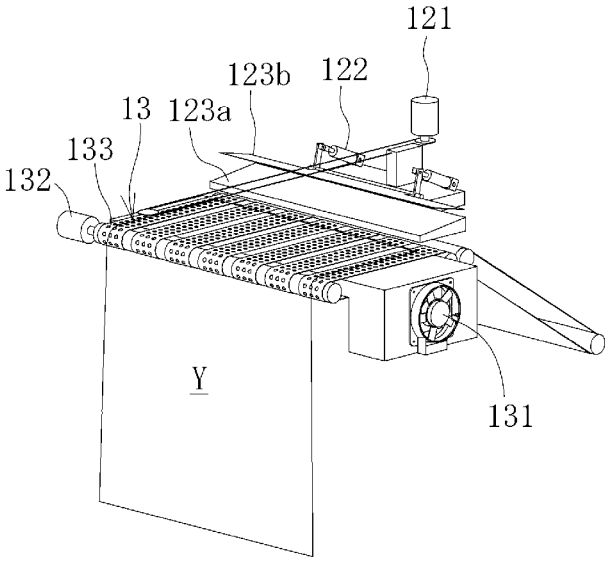
FIG. 33 is an enlarged perspective view of the forward-backward moving device and the transfer conveyor of the automatic cloth spreading machine of FIG. 1.

To move the cloth Y from the roller 10 onto the transfer conveyor 13 by the forward-backward moving device 12, as shown in FIG. 28, the first roller part 102 and the second roller part 103 are rotated toward the forward-backward moving device 12 at the same time and at the same speed, so that the side edge Ye (the upper end in FIG. 28) of the cloth Y located near the sensor groups 108, 109 is moved closer to the forward-backward moving device 12. Furthermore, as shown in FIG. 29, the holding unit of the forward-backward moving device 12 is moved forward, and a leading end of the holding platform 123*a* of the holding unit with the holding plate 123*b* opened is pressed against a blowing member 10*a* installed under the roller 10, so as to hold a portion of the cloth Y on the roller 10, which is a portion on the side of the transfer conveyor 13, between the leading end of the holding platform 123*a* and the blowing member 10*a*. In this state, as shown in FIG. 30, air is ejected from the blowing member 10*a* and, at the same time, the first roller part 102 and the second roller part 103 are further rotated toward the forward-backward moving device 12. As a result, the above side edge Ye of the cloth Y is placed on the holding platform 123*a*. Thereafter, as shown in FIG. 31, the holding plate 123*b* is closed and the side edge Ye of the cloth Y is held between the holding plate 123*b* and the holding platform 123*a*. The portion of the cloth Y other than the portion held between the holding platform 123*a* and the holding plate 123*b* of the holding unit droops from the holding platform 123*a*. In this state, as shown in FIG. 32, the holding unit of the forward-backward moving device 12 is moved toward the transfer conveyor 13. After the holding unit is moved backward a predetermined distance, as shown in FIG. 33, the holding plate 123*b* is opened again and the cloth Y is moved onto the transfer conveyor 13. In addition, the holding unit of the forward-backward moving device 12 continues to be moved backward a predetermined distance also after the holding plate 123*b* releases the cloth Y.

Figure 34:
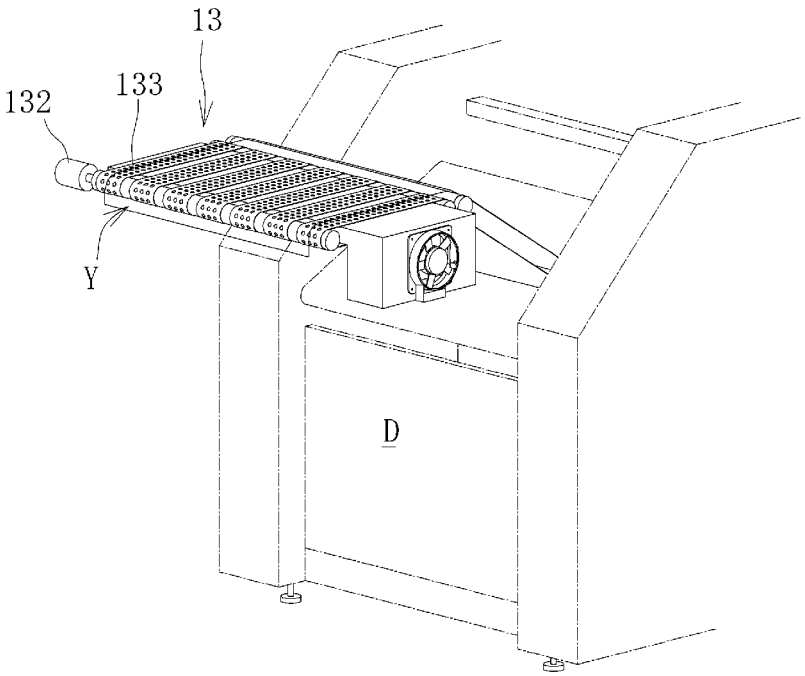
FIG. 34 is an enlarged perspective view of the transfer conveyor of the automatic cloth spreading machine of FIG. 1 and a cloth folding machine in the next process.
Figure 35:
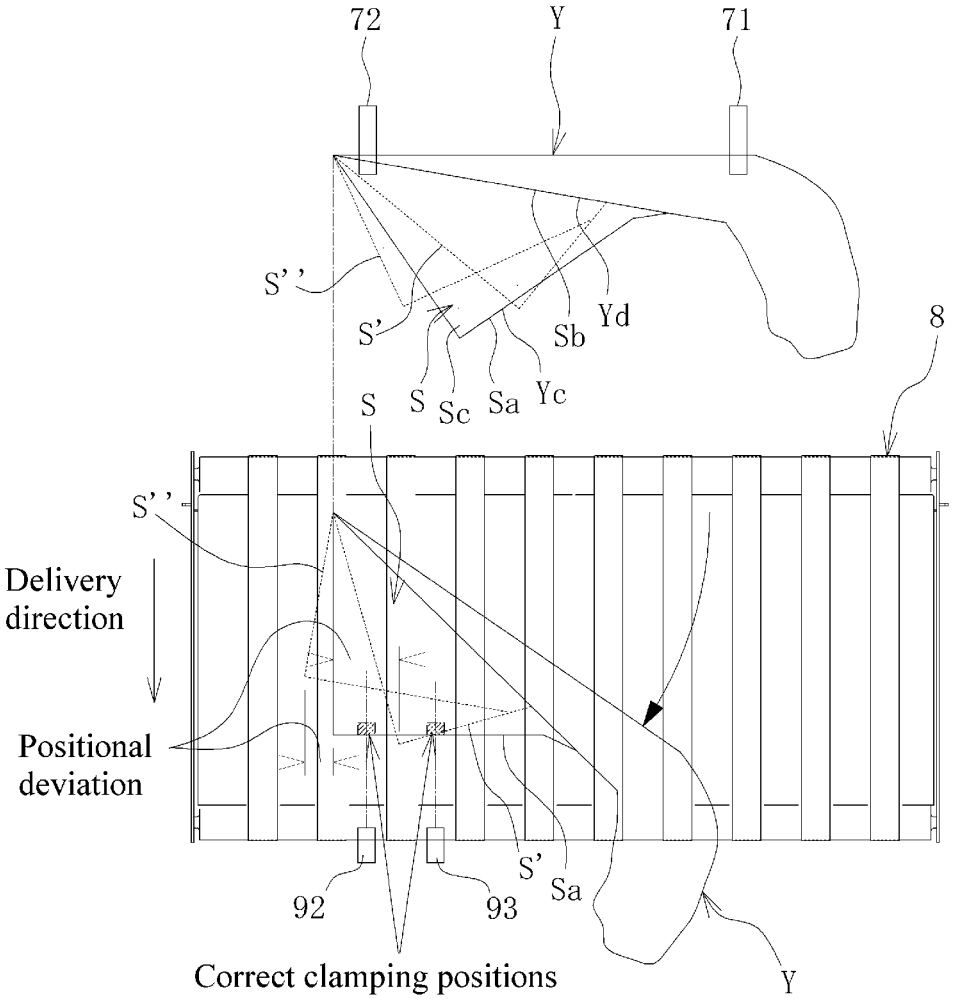
FIG. 35 is a schematic view illustrating failures in locating and clamping an edge by using an edge clamping device of the prior art.
Figure 36:
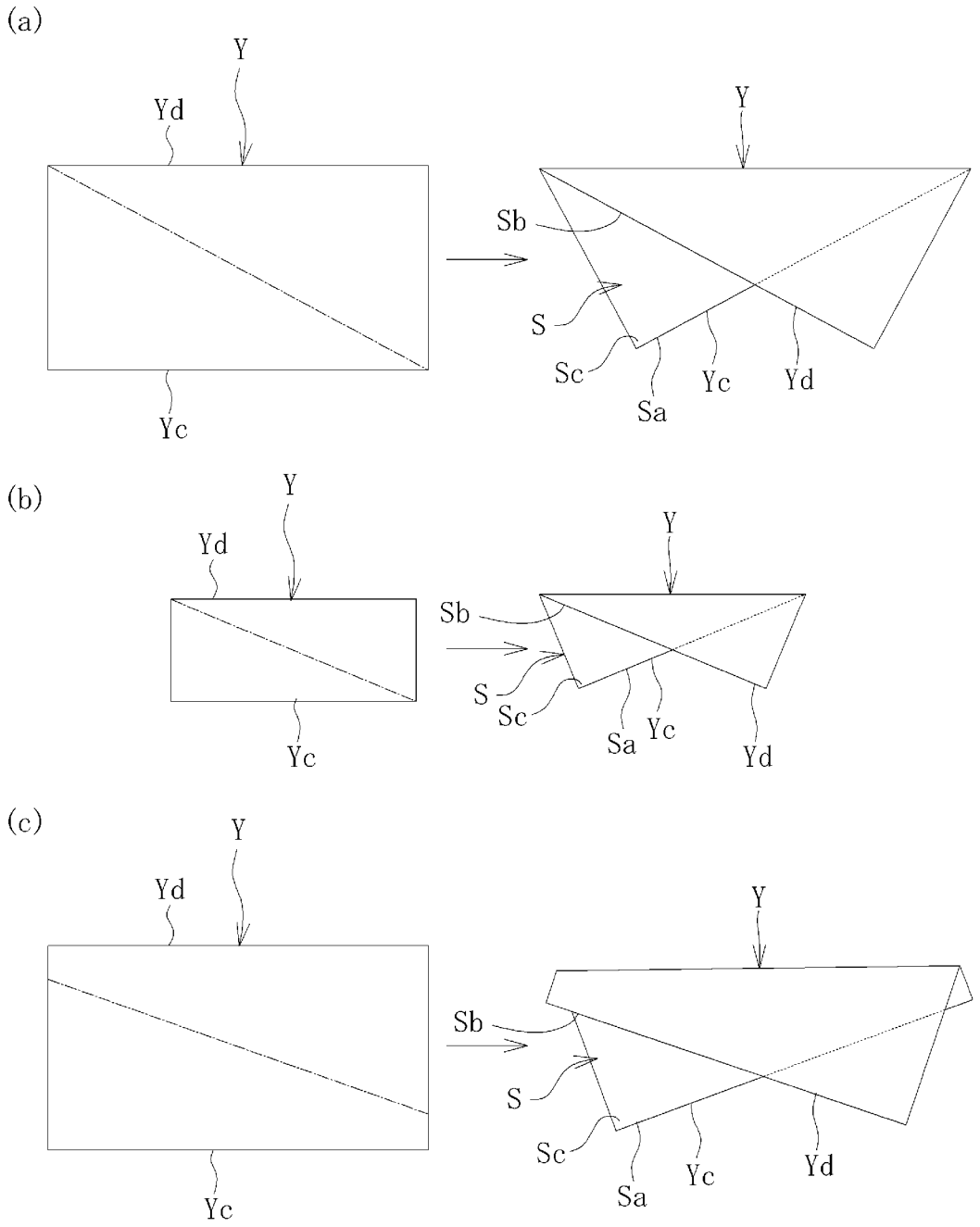
FIG. 36 (*a*) to FIG. 36 (*c*) are views illustrating that right-angled triangular parts varying in shape and size appear when pieces of cloth varying in size are folded.
Figure 37:
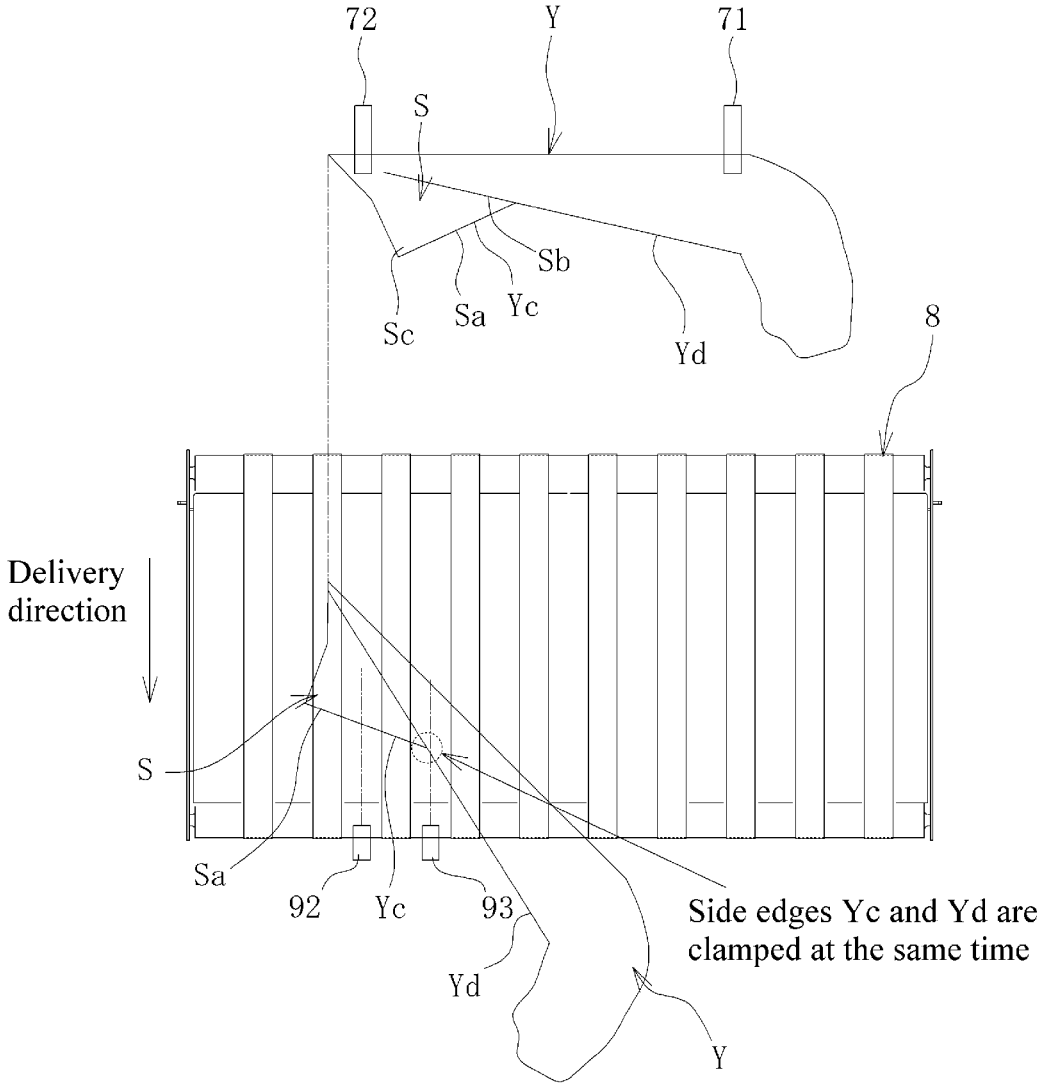
FIG. 37 is a schematic view illustrating a failure in locating and clamping an edge by using the edge clamping device of the prior art.

As shown in FIG. 34, the transfer conveyor 13 has a belt 133 having a large number of through-holes, a motor 132 that drives the belt 133, and a suction fan 131 that suctions the spread cloth Y on the belt 133 through the through-holes formed in the belt 133. As the cloth Y on the transfer conveyor 13 is thus suctioned, the side edge Ye of the cloth Y held by the holding unit of the forward-backward moving device 12 can fall and smoothly move onto the transfer conveyor 13. Thereafter, the transfer conveyor 13 discharges the cloth Y and transfers (feeds) the cloth Y to the next process (here, the cloth folding machine D). In addition, the belt 133 of the transfer conveyor 13 need not be driven while the holding unit of the forward-backward moving device 12 moves the cloth Y onto the transfer conveyor 13. However, it is preferable that the belt 133 be driven from the viewpoint of increasing the number of pieces of cloth to be processed.

The automatic cloth spreading machine configured as described above requires simply feeding the washed and dried cloth Y onto the supply conveyor 1. Then, the cloth Y can be automatically spread and transferred (fed) to the next process by the lifting device 2, temporary holding device 3, corner end locating device 4, corner end receiving device 5, horizontal pulling device 6, two-position holding device 7, edge locating conveyor 8, vertically inverting device 9, roller 10, hanging device 11, forward-backward moving device 12, transfer conveyor 13, etc.

Further, the edge clamping device and the automatic cloth spreading machine including this device of the embodiment are configured to be able to move the two-position holding device 7 in the crosswise direction (the front-rear direction in FIG. 1) relative to the delivery direction of the edge locating conveyor 8 by the moving mechanism 7B as the position changing means. Even when the shape and size of the right-angled triangular part S appearing in the cloth Y held by the two-position holding device 7 vary due to a change in the type of cloth Y to be processed etc., the moving mechanism 7B thereby compensates for the positional deviation of the right-angled triangular part S from the correct clamping position corresponding to the positions of the clamping chucks 92, 93. Therefore, the edge clamping device and the automatic cloth spreading machine including this device of the embodiment can clamp the cloth Y, of which the edge has been located on the edge locating conveyor 8, in a reliable manner and at the correct position by the clamping chucks 92, 93. This makes it possible to process a plurality of types of cloth varying in shape and size by a single edge clamping device.

When the configuration is adopted in which the edge clamping device includes the sensor 78 that detects the position of the right-angled portion Sc of the right-angled triangular part S in a state where the two-position holding device 7 is holding two portions of the cloth Y, and in which the moving mechanism 7B as the position changing means moves the two-position holding device 7 in the crosswise direction relative to the delivery direction of the edge locating conveyor 8 based on the position of the right-angled portion Sc detected by the sensor 78, measurement and compensation of the amount of positional deviation of the right-angled triangular part S can be automatically performed.

Further, when the two-position holding device 7 has the interval changing mechanism that changes the distance between the pair of holding chucks 71, 72, which is formed by the cylinder 70*a* in the above example, the distance between the pair of holding chucks 71, 72 can be changed according to the size of the cloth Y to be processed. Thus, when processing a plurality of types of cloth Y varying in shape and size, it is possible to always hold similar portions, for example, a front end portion and an intermediate portion, or a front end portion and a rear end portion, and to prevent deformation etc. of the cloth Y being held, which can enhance the accuracy in locating the edge on the edge locating conveyor 8.

In addition, in the above description, an aspect in which the positional deviation of the right-angled triangular part S from the correct clamping position is compensated for by the position changing means moving the two-position holding device 7 in the crosswise direction relative to the delivery direction of the edge locating conveyor 8 has been described. However, the present invention is not limited to this aspect, and the edge locating conveyor 8 itself may be moved in the crosswise direction. Further, the clamping chucks 92, 93 or the vertically inverting device 9 itself that supports the clamping chucks 92, 93 may be moved in the crosswise direction. Alternatively, two or more of the two-position holding device 7, the edge locating conveyor 8, the clamping chucks 92, 93, and the vertically inverting device 9 may be relatively moved at the same time. Also in these modified examples, it is preferable that the sensor 78 detect the right-angled portion Sc of the right-angled triangular part S to obtain the amount of positional deviation from the correct clamping position, and that the amount of movement is determined so as to compensate for this amount of positional deviation. Further, also in these modified examples, it is preferable that the two-position holding device 7 is provided with an interval changing mechanism like the cylinder 70*a* that changes the distance between the pair of holding chucks. Moreover, the two-position holding device 7 may have three or more holding chucks, and arbitrary two of these holding chucks may be used as the pair of holding chucks according to the dimension of the cloth to be processed etc.

INDUSTRIAL APPLICABILITY

The present invention can provide an edge clamping device that can clamp cloth, of which an edge has been located on an edge locating conveyor, in a reliable manner and at a correct position, and an automatic cloth spreading machine including this device.

REFERENCE SIGNS LIST

1 Supply conveyor
2 Lifting device
3 Temporary holding device
4 Corner end locating device
5 Corner end receiving device
6 Horizontal pulling device
7 Two-position holding device
7A Forward-backward moving device
7B Moving mechanism
8 Edge locating conveyor
9 Vertically inverting device
10 Roller
11 Hanging device
11A Hanging movable body
12 Forward-backward moving device
13 Transfer conveyor
70*a* Cylinder
78 Sensor
S Right-angled triangular part
Sa Adjacent side
Sb Hypotenuse
Sc Right-angled portion
Y Cloth
Yc Side edge on a side to be located
Yd Opposite side edge

The invention claimed is:

1. An edge clamping device comprising:

a two-position holding device having a pair of holding chucks that hold two separate portions of a rectangular piece of cloth that are on or near a ridge of a fold, in a state where the cloth has been folded with a side edge on a side to be located and the opposite side edge intersecting each other so as to reveal a right-angled triangular part of which an adjacent side is formed by a portion of the side edge on the side to be located that is adjacent to a corner of intersection while a hypotenuse is formed by a portion of the opposite side edge that defines the corner of intersection with the adjacent side;

an edge locating conveyor that is disposed under the two-position holding device with a delivery direction oriented in a direction orthogonal to a direction in which the pair of holding chucks face each other, and delivers the cloth having been released from the two-position holding device; and a clamping chuck disposed downstream of the edge locating conveyor in the delivery direction, the two-position holding device releasing the two held portions separately and letting them fall onto the edge locating conveyor at different timings such that the portion on the side of the right-angled triangular part follows; the adjacent side of the right-angled triangular part being located on the edge locating conveyor; the clamping chuck clamping a peripheral portion inside the right-angled triangular part including the located adjacent side, wherein the edge clamping device includes a position changing means that moves at least one of the two-position holding device, the edge locating conveyor, and the clamping chuck in a crosswise direction relative to the delivery direction such that the right-angled triangular part of the cloth held by the two-position holding device is located at a correct clamping position corresponding to the position of the clamping chuck.

2. The edge clamping device according to claim 1, comprising a sensor that detects a position of a right-angled portion of the right-angled triangular part in a state where the two-position holding device is holding two portions of the cloth, wherein the position changing means is configured to move at least one of the two-position holding device, the edge locating conveyor, and the clamping chuck in a crosswise direction relative to the delivery direction based on the position of the right-angled portion detected by the sensor.

3. The edge clamping device according to claim 2, wherein the position changing means has a moving mechanism that moves the two-position holding device in a crosswise direction relative to the delivery direction.

4. The edge clamping device according to claim 3, wherein the two-position holding device has an interval changing mechanism that changes a distance between the pair of holding chucks.

5. An automatic cloth spreading machine characterized by comprising:

the edge clamping device according to claim 4;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

6. An automatic cloth spreading machine characterized by comprising:

the edge clamping device according to claim 3;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

7. The edge clamping device according to claim 2, wherein the two-position holding device has an interval changing mechanism that changes a distance between the pair of holding chucks.

8. An automatic cloth spreading machine characterized by comprising:

the edge clamping device according to claim 7;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

9. An automatic cloth spreading machine characterized by comprising:

the edge clamping device according to claim 2;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

10. The edge clamping device according to claim 1, wherein the position changing means has a moving mechanism that moves the two-position holding device in a crosswise direction relative to the delivery direction.

11. The edge clamping device according to claim 10, wherein the two-position holding device has an interval changing mechanism that changes a distance between the pair of holding chucks.

12. An automatic cloth spreading machine characterized by comprising:

the edge clamping device according to claim 11;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

13. An automatic cloth spreading machine characterized by comprising:

the edge clamping device according to claim 10;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

14. The edge clamping device according to claim 1, wherein the two-position holding device has an interval changing mechanism that changes a distance between the pair of holding chucks.

15. An automatic cloth spreading machine characterized by comprising:

the edge clamping device according to claim 14;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

16. An automatic cloth spreading machine characterized by comprising:

the edge clamping device according to claim 1;

a vertically inverting device that inverts the clamping chuck having clamped cloth;

a roller disposed under the edge locating conveyor;

a hanging movable body that receives cloth from the inverted clamping chuck and hangs the received cloth onto a circumferential surface of the roller; and a forward-backward moving device that is provided so as to be able to move forward and backward relatively to the roller, and spreads the cloth by clamping, at a forward position, the cloth hung on the roller and then moving backward.

* * * * *